US008121523B2

(12) United States Patent
Stelter

(10) Patent No.: US 8,121,523 B2
(45) Date of Patent: Feb. 21, 2012

(54) DEVELOPER STATION WITH TAPERED AUGER SYSTEM

(75) Inventor: Eric C. Stelter, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 4 days.

(21) Appl. No.: 12/415,508

(22) Filed: Mar. 31, 2009

(65) Prior Publication Data

US 2010/0247155 A1 Sep. 30, 2010

(51) Int. Cl.
*G03G 15/08* (2006.01)

(52) U.S. Cl. ..... 399/256

(58) Field of Classification Search ..... 399/107, 399/119, 120, 252–258
See application file for complete search history.

(56) References Cited

U.S. PATENT DOCUMENTS

| | | | |
|---|---|---|---|
| 6,764,798 | B2 | 7/2004 | Yamazaki et al. |
| 6,861,190 | B2 | 3/2005 | Yamazaki et al. |
| 6,875,550 | B2 | 4/2005 | Miyakawa et al. |
| 6,916,586 | B2 | 7/2005 | Ishiyama et al. |
| 6,994,942 | B2 | 2/2006 | Miyakawa et al. |
| 7,011,920 | B2 | 3/2006 | Nagai et al. |
| 7,022,447 | B2 | 4/2006 | Miyakawa |
| 7,142,791 | B2 | 11/2006 | Yuge |
| 7,190,928 | B2 | 3/2007 | Miyakawa et al. |
| 7,235,337 | B2 | 6/2007 | Kameyama et al. |
| 7,343,120 | B2 | 3/2008 | Slattery et al. |
| 7,343,121 | B2 | 3/2008 | Slattery et al. |
| 7,348,120 | B2 | 3/2008 | Eida et al. |
| 7,426,361 | B2 | 9/2008 | Thompson et al. |
| 7,481,884 | B2 | 1/2009 | Stelter et al. |
| 7,561,833 | B2 * | 7/2009 | Stelter et al. ..... 399/258 |
| 2009/0052950 | A1 | 2/2009 | Brown et al. |
| 2009/0074469 | A1 | 3/2009 | Stelter et al. |

FOREIGN PATENT DOCUMENTS

WO WO 2007/053763 A1 5/2007

* cited by examiner

*Primary Examiner* — Hoan Tran
(74) *Attorney, Agent, or Firm* — Donna P. Suchy

(57) ABSTRACT

A developer station and method for an electrographic printer is provided that reduces developer agitation. The developer station includes a sump for holding a reservoir of magnetic developer including a toner and carrier and a magnetic auger mounted above the sump and including a rotatable magnetic core surrounded by a substantially cylindrical rotatable toning shell rotatably mounted with respect to the core, the shell being adjacent to the photoconductor member and defining a nip and a conveyance device for transporting developer in the developer station in a flow direction. The conveyance device has a tapered auger including a shaft and one or more blades such that the developer volume in the flow direction is controlled to maintain a uniform developer level in the sump as well as a conveyance controller for controlling the conveying device, including the tapered auger such that the tapered auger preferentially creates an uniform layer of developer on the toning shell.

25 Claims, 15 Drawing Sheets

DEVELOPER STATION WITH TAPERED AUGER SYSTEM

CROSS REFERENCE TO RELATED APPLICATIONS

This application relates to commonly assigned, copending U.S. application Ser. No. 12/415,380, filed Mar. 31, 2009, entitled: "DEVELOPER STATION FOR AN ELECTROGRAPHIC PRINTER HAVING REDUCED DEVELOPER AGITATION", U.S. application Ser. No. 12/1415,439, filed Mar. 31, 2009, entitled: "DEVELOPER STATION WITH AUGER SYSTEM" and U.S. application Ser. No. 12/415,476, filed Mar. 31, 2009, entitled: "DEVELOPER STATION FOR AN ELECTROGRAPHIC PRINTER WITH MAGNETICALLY ENABLED DEVELOPER REMOVAL."

FIELD OF THE INVENTION

This invention generally relates to electrographic printers, and is particularly concerned with a developer station and methods that improve the mixing and feed of a magnetic developer from a sump to a rotating magnetic brush.

BACKGROUND OF THE INVENTION

Electrographic printers that use a rotating magnetic brush to apply a dry, particulate developer to a photoconductor member are known in the art. In such electrographic printers, the rotating magnetic brush includes a rotatable magnetic core surrounded by a rotatable, cylindrical toning shell that is eccentrically mounted with respect to the axis of rotation of the magnetic core. The magnetic brush is mounted adjacent to a developer sump that holds a reservoir of dry, two-component developer including a mixture of ferromagnetic carrier particles and toner particles capable of holding an electrostatic charge. The eccentric mounting of the toning shell defines an area of relatively strong magnetic flux where the shell comes closest to the magnetic core, and an area of relatively weak magnetic flux 180° opposite to the area of strongest magnetic flux where the shell is farthest away from the core. The area of strongest magnetic flux also contains a line of closest approach between the toning shell of the magnetic brush and the photoconductor member. This line of closest approach defines a "nip" between these two components where the particulate toner component of the developer is transferred to the photoconductor member as a result of electrostatic attraction between the toner particles and the electrostatic field from the photoconductor member. The combination of the magnetic brush and the developer sump is referred to as the developer station in this application.

In operation, the photoconductive member is moved past a pre-cleaner and a cleaning station to remove any residual toner that might be on the surface of the member after the previous image transfer. A corona charger then imparts a uniform static charge on to the surface of the member. The photoconductive member is next moved past an image writing station (which may include an LED bar) that writes a latent, electrostatic image on the member by exposing it to a pattern of light. Next, the exposed photoconductor member is moved past the developer station, where the magnetic brush develops the latent electrostatic image on the member by continuously applying a uniform layer of developer at the nip between the toning shell and the photoconductor member. At the nip, toner particles in the developer are transferred to the photoconductor member in a pattern commensurate with the electrostatic image on the member. The developed image on the photoconductor member is then transferred to, for example, an intermediate transfer web for subsequent transfer to a final receiver. The developer that remains on the toning shell downstream of the nip is removed by a skive and deposited back in the developer sump. The used, toner-depleted developer is replenished as needed with additional toner particles in the sump. Replenished developer is continuously applied downstream of the skive far from the toning nip at or near the area of weakest magnetic flux on the toning shell of the magnetic brush, where it is moved back toward the area of strongest magnetic flux and the nip.

In color printing, a series of electrographic printers arranged in tandem are used to create image separations in different primary colors (i.e. cyan, magenta, yellow, and black) which are superimposed over one another to create a final color image. To this end, each printer prints its particular primary color image on an intermediate transfer web which resembles a conveyor belt. The conveyor-belt movement of the intermediate transfer belt is synchronized with the printing by the photoconductor members of the in tandem printers such that the images are superimposed in alignment with one another, creating a final color image.

It is highly desirable for the intermediate transfer web to be horizontally oriented so the height of the resulting color printing assembly is less than a standard room ceiling height. As a consequence, the intermediate transfer web should engage the photoconductor element of each printer at either the 6 o'clock position in a "process-over-image" configuration, or in a 12 o'clock position in an "image-over-process" configuration. As a further consequence, the nip between the toning shell and the photoconductor member should be located at one or the other of the sides of the photoconductor member, preferably near the 9 o'clock or 3 o'clock position.

It is further desirable to use a photoconductor that is as small in diameter as possible to reduce cost and overall printer size. The pre-clean, clean, charge, expose, develop, and transfer stations must all be positioned adjacent to the photoconductor member. If a small photoconductor member is used, all of these systems must also be as small as possible so as not to interfere with each other or the intermediate transfer web, yet still produce adequate images. Hence there are limitations on, in particular, the height of developer station positioned at the 9 o'clock or 3 o'clock position relative to the photoconductor member.

It is also desirable to print images as quickly as possible, requiring faster printer speeds. The combination of small size and high process speed is technologically demanding. From a fundamental point of view, large fluxes of charge, light, or particles are needed due to the high rates required for the short time allowed for each process step. This means in general that, as speed is increased and size is decreased, larger concentrations, intensities, and driving forces are used.

Faster printing can be accomplished by increasing the rotational speed of the magnetic brush. However, the inventors have observed that increasing the rotational speed of the magnetic core can produce undesirable effects, such as embedment of toner and heating of carrier particles that ages the developer. Also, increasing the rotational speed of the magnetic core can cause toner particles to fracture and produce small particles, or fines. To fully appreciate the first-mentioned problem, some explanation of the constitution of the toner particles is in order.

A widely practiced method of improving the transfer of the toner particles is by use of so-called surface treatments. Such surface treated toner particles have adhered to their surfaces sub-micron particles, e.g., of silica, alumina, titania, and the like (so-called surface additives or surface additive particles).

Surface treated toners generally have weaker adhesion to a smooth surface than untreated toners, and therefore surface treated toners can be electrostatically transferred more efficiently from a photoconductor member to another member. Such surface treated toners also advantageously maintain the same amount of electrostatic attractive force with respect to the photoconductor member despite variations in the ambient humidity.

In particular, the inventors have observed that, when the rotational speed of the rotating magnetic core is increased beyond a certain limit, the carrier particles become excessively heated as a result of hysteresis of the magnetization of the carrier particles caused by the rapidly changing magnetic field of the rotating core. The resulting heat is transferred from the carrier particles to the toner particles, which in turn softens them. The rapidly changing magnetic field of the rotating core also creates excessive mechanical agitation in the toner. The resulting heating, softening, and mechanical impact between the carrier particles and the toner particles causes the sub-micron surface-treatment particles of silica, alumina, titania, and the like to embed into the toner particles, thereby diminishing the ability of the toner particles to hold the static charges necessary for reliable and consistent transfer to the photoconductor member.

It is also desirable to improve the efficiency of the process of skiving the developer that remains on the toning shell downstream of the nip and depositing that developer back in the developer sump. It is also desirable to reduce the expense of the precision required for a straight, thin skive spaced close to the toning shell with a small spacing tolerance and to generally improve the removal of developer from the magnetic brush without interfering with other aspects of the development system.

In addition, a developer station of relatively small size capable of high printing speed in a printer of compact size necessarily has a small, narrow developer sump. For a small sump, a significant fraction of the developer in the sump can be removed from the sump and applied to the toning shell of the magnetic brush. This can result in poor feed of the developer to portions of the toning shell if the volume of developer in the sump is not constant adjacent the toning shell. It is desirable to improve the mixing of developer and the feed of a magnetic developer from the sump to the rotating magnetic brush.

SUMMARY OF THE INVENTION

The invention is a developer station and method for an electrographic printer that improves the mixing and feed of developer from the sump to the toning shell during the printing process. The developer station includes a sump for holding a reservoir of magnetic developer including toner and carrier and a magnetic roller mounted above said sump and including a rotatable magnetic core surrounded by a substantially cylindrical rotatable toning shell rotatably mounted with respect to the core, said shell being adjacent to the photoconductor drum and defining a nip and a conveyance device for transporting developer in the developer station in a flow direction. The conveyance device has a tapered auger including a shaft and one or more blades such that the developer volume in the flow direction is controlled to maintain a uniform developer level in the sump as well as a conveyance controller for controlling the conveying device, including the tapered auger such that the tapered auger preferentially creates an uniform layer of developer on the toning shell.

When a relatively high speed printing operation is carried out such that magnetic carrier particles on the toning shell are subjected to at least about 190 pole flips per second as a result of relative rotation between the magnetic core and the toning shell, developer is preferably delivered to the toning shell at an angular distance no more than about 120° from the tangent line between the toning shell and the photoconductor member to reduce the residence time that the developer stays on the developer shell prior to transfer of toner particles from the toning shell to the photoconductor element.

In a method of the invention, for relatively high speed printing operations in which a large proportion of developer from the sump is fed at a high rate from the sump to the toning shell and returned from the toning shell to the sump, auger assemblies and sump features of specific construction are used to provide a uniform level of developer in the sump adjacent the conveyor roller or toning shell and to provide uniform feed of developer to the toning shell.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1A:
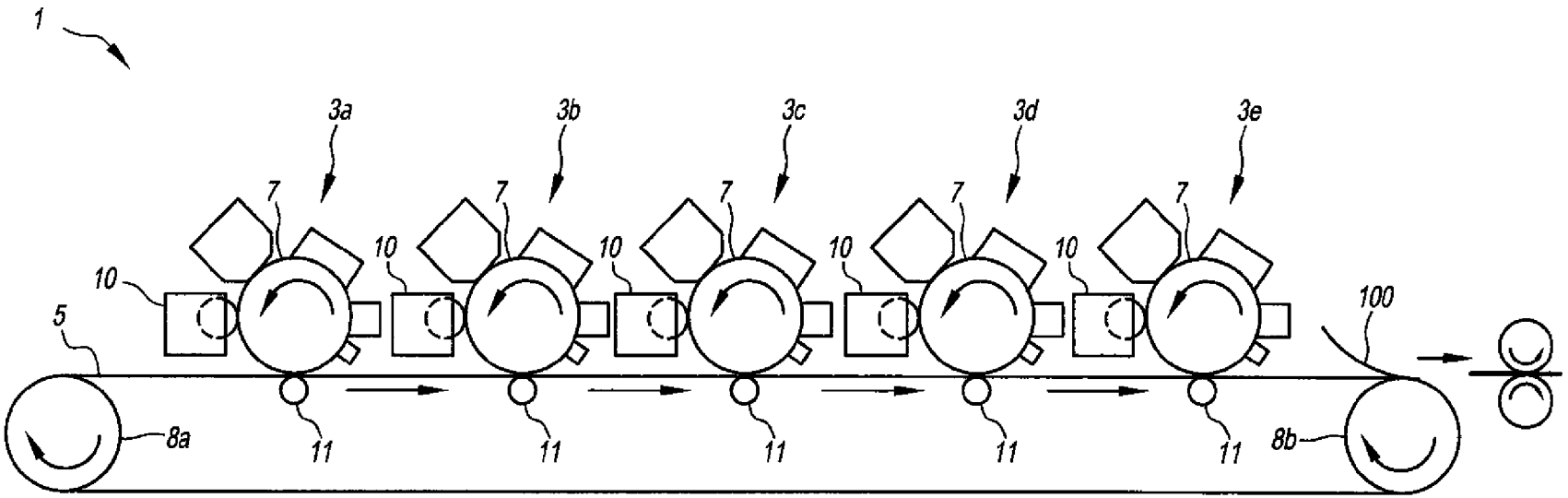
FIG. 1A is a schematic side view of a typical electrographic printing assembly in process-over-image configuration suitable for use with the developer station of the invention.
Figure 1B:
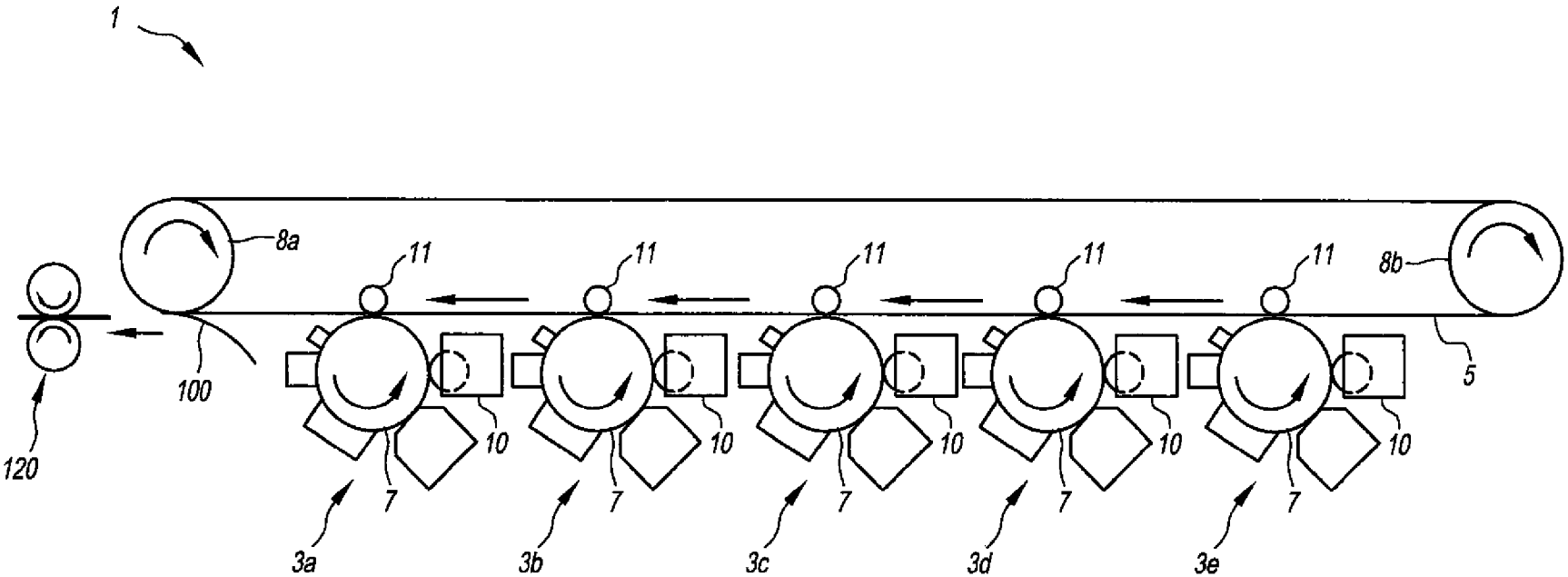
FIG. 1B is a schematic side view of a typical electrographic printing assembly in image-over-process configuration suitable for use with the developer station of the invention.

With reference to FIG. 1A, an electrographic printing apparatus 1 has a number of tandemly arranged electrostatographic image-forming printers in the form of printer modules 3*a*, 3*b*, 3*c*, 3*d*, and 3*e*. Each of the printer modules 3*a*-3*e* is disposed over a horizontally-oriented intermediate transfer web 5 in process-over-image configuration, although the invention is equally applicable to a printing apparatus 1 wherein the intermediate transfer web is disposed above the printer modules 3*a*-3*e* in image-over-process configuration, as shown in FIG. 1B. Each printer module 3*a*-3*e* includes a photoconductor element which may take the form of a photoconductor drum 7. In FIG. 1A, the top portion of the intermediate transfer web 5 is moved from left to right by rollers 8*a*, 8*b* in conveyor-belt fashion immediately beneath the photoconductor drum 7 of each printer modules 3*a*-3*e* while the photoconductor drums rotate counterclockwise at the same speed. Each of the printer modules 3*a*-3*d* includes a developer station 10 that develops a single-color toner image such as black (K), cyan (C), magenta (M), or yellow (Y) onto the photoconductor drum 7. Printer module 2*e* may include an additional color toner or a clear toner for transfer of clear images to the intermediate transfer web 5. A backer bar 11 having an electrostatic voltage transfers the toner image off of the drum 7 of each of the printer modules 3*a*-3*e* and onto the web 5. In operation, the intermediate transfer web 5 is first passed through module 3*a*, where it receives a first toner image. Subsequent toner images are superimposed in registry with this first toner image as it passes through printer modules 3*b*-3*e* in order to form a single pentachrome image, and one clear toner image. The single pentachrome image is ultimately transferred to a receiver such as a sheet of paper 100 and then fused into a permanent color image in a fuser assembly 120 in a manner well-known in the art.

In FIG. 1B, for the image-over-process configuration, the bottom portion of the intermediate transfer web 5 is moved from right to left by rollers 8*a*, 8*b* in conveyor-belt fashion immediately above the photoconductor drum 7 of each printer modules 3*a*-3*e* while the photoconductor drums 7 rotate counterclockwise at the same speed. For the image-over-process configuration shown in FIG. 1B, each of the printer modules 3*a*-3*d* perform the same functions as for the process-over-image configuration shown in FIG. 1A.

Figure 2:
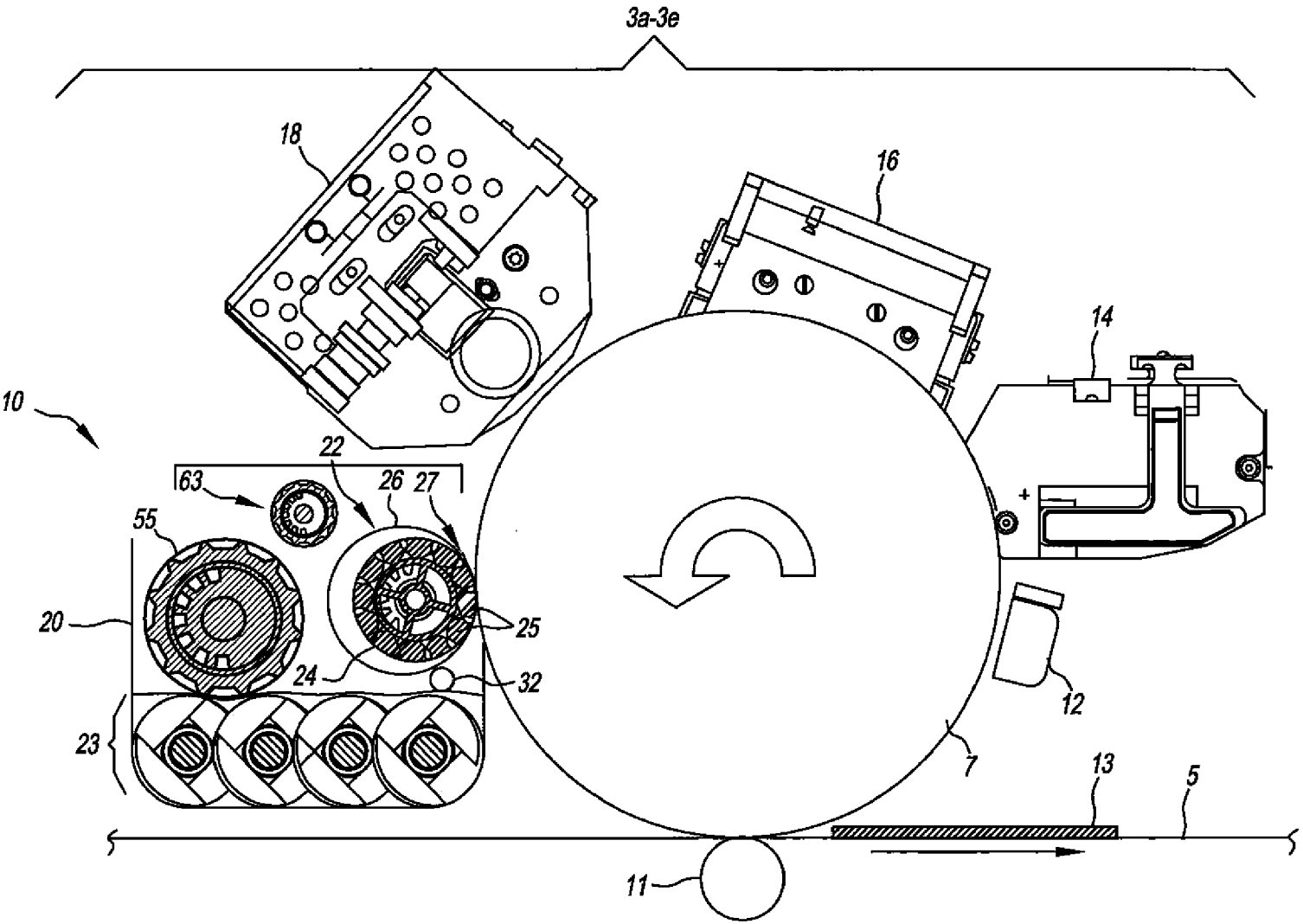
FIG. 2 is a side view, in partial cross section, of one of the printing modules used in the printing assembly of FIG. 1A, on an enlarged scale.

With reference now to FIG. 2, each of the printer modules 3*a*-3*e* includes a pre-cleaner unit 12 having a corona charger and a lamp for recharging, exposing and discharging residual electrostatic charge on the photoconductor drum 7 that remains after the transfer of the toner image 13 onto the web 5. Such electrostatic neutralizing of the drum 7 facilitates the removal of residual toner particles by the toner cleaner 14 located downstream of the pre-cleaner unit. A corona charger 16 is located downstream of the toner cleaner 14. Charger 16 imparts a negative charge of between about 600 and 700 volts to the surface of the photoconductor drum 7. An optical image writer 18 is located downstream of the corona charger 16. Writer 18 includes a digitally-controlled LED bar that exposes the surface of the photoconductor drum 7 to a modulated light signal, which in turn selectively discharges portions of the charged surface of the photoconductor drum such that a latent electrostatic image is written across the surface of the photoconductor drum 7.

Figure 3A:
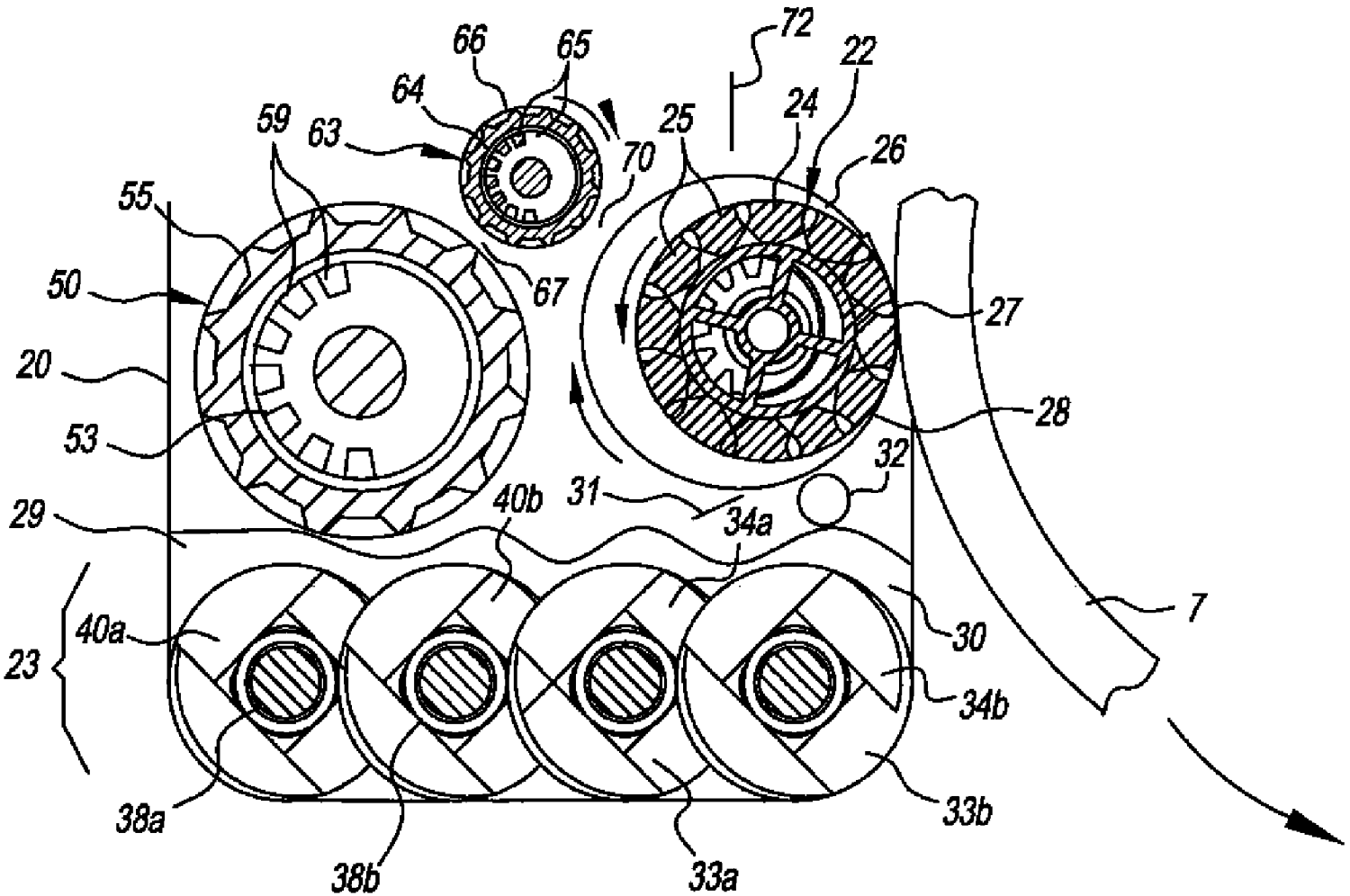
FIG. 3A is a cross sectional side view of a first embodiment of the developer station of the invention which may be used in the printing module illustrated in FIG. 2 and which employs two conveyor rollers.

With reference now to FIGS. 2 and 3A, the developer station 10 includes a housing 20, a magnetic brush 22, and a developer sump 23. The magnetic brush 22 is also known as the combination of the developer and the toning roller. The toning roller includes a magnetic core 24 having a plurality of magnets 25 arranged around its outer periphery and a toning shell. The core 24 is rotatably mounted with respect to the housing 20. While not expressly shown, the north-south magnetic axes of the magnets are radially-oriented with respect to the cylindrically-shaped core 24, and the magnets 25 are arranged with alternating north and south magnetic poles around the outer periphery of the core 24 such that "U" shaped lines of magnetic flux interconnect adjacent magnets. The magnetic core 24 is surrounded by a rotatably mounted, cylindrically shaped toning shell 26. Toning shell 26 may be eccentrically mounted with respect to the magnetic core as shown. The axes of rotation of the toning shell 26 and the photoconductor drum 7 are parallel as indicated, and a first nip 27 is defined at the line of closest approach between the cylindrically-shaped toning shell 26 and the photoconductor drum 7. The axes of rotation of the magnetic core 24 and the toning shell 26 are also parallel, and the line of closest approach between these two components defines the location 28 where the magnetic field on the toning shell 26 is generally greatest in magnitude.

With reference to FIG. 3A, the sump 23 contains a reservoir 29 of two-component developer 30 formed from a dry mixture of magnetic carrier particles and toner particles. Preferably, the carrier particles are hard magnetic ferrite particles having high coercivity. The carrier particles may have a volume-weighted diameter of approximately 26 mu.m. The dry toner particles are preferably substantially smaller, (on the order of 6.mu.m to 15.mu.m in volume-weighted diameter). The toner particles are removed from the carrier particles during the development operation that occurs at the nip 27 between the toning shell 26 and the photoconductor drum 7. The toner particles are polymeric or resin-based, and are electrostatically chargeable. The toner particles are created by blending various components, which can include binders, resins, pigments, fillers, and additives, for example, and processing the components by heating and milling, for example, whereupon a homogeneous mass is dispensed by an extruder. The mass is then cooled, crushed into small chips or lumps, and then ground into a powder. As previously mentioned, a widely practiced method of improving the transfer of the toner particles is by use of so-called surface treatments. Such surface treated toner particles have adhered to their surfaces sub-micron particles, e.g., of silica, alumina, titania, and the like which in turn improves the electrostatic properties of the toner particles.

The sump 23 of the developer station 10 functions to continuously provide a supply of developer 30 to the toning shell 26 of the magnetic brush 22 having a correct proportion of toner particles relative to magnetic carrier particles. As is well known in the art, when developer 30 is used to develop a latent electrostatic image on the photoconductor drum 7, the toner particles in the developer are electrostatically transported from the toning shell 26 to the drum 7, while the magnetic carrier particles remain on the toning shell 26. These remaining magnetic carrier particles and unused developer are removed from the toning shell by a skive 31 and are redeposited back into the right-hand side of the reservoir 29 of developer 30. The area of the magnetic brush where the developer is removed and returned to the sump is referred to as the strip zone. The skive 31 is located in the strip zone of magnetic brush 22. The strip zone is above the sump. In order to maintain a correct proportion of carrier and toner particles in the developer conveyed to the toning shell 26, a toner replenisher tube 32 conveys toner particles to the right-hand side of the developer reservoir 29 as needed. Sump 23 further includes a pair of return augers 33*a*, 33*b* having left-handed screw blades 34*a*, 34*b* in the augers and/or auger assemblies for simultaneously conveying the developer particles stripped away from the developing shell 26 by the skive 31 and the toner particles added by the replenisher tube 32 (along with other developer in the sump 23) to a front mixing chamber (not shown) 35 where flippers on the return augers 33*a*, 33*b* mix the carrier particles and toner particles to form a replenished developer which is conveyed from the front mixing chamber to feed augers 38*a*, 38*b*. The feed augers 38*a*, 38*b* have left-handed screw blades 40*a*, 40*b* which convey the replenished toner down the length of the sump 23. Flippers at the rear ends of feed augers 38*a* and 38*b* (not shown) convey the developer to return augers 33*a* and 33*b*. Augers are also referred to as auger assemblies and an auger assembly can have one or more augers. In this example of the invention, the return augers 33*a*, 33*b* turn counterclockwise while the feed augers 38*a*, 38*b* turn clockwise, thereby causing the developer to circulate around the sump 23 in a clockwise direction when viewed from above.

With reference again to FIG. 3A, the developer station 10 further includes first and second conveyor rollers 50, 63 for conveying developer to the toning shell 26. Conveyor rollers are also referred to as transport rollers. The first conveyor roller 50 includes a stationary magnetic core 53 surrounded by a rotatable cylindrical shell 55. The rotatable shell 55 of the roller 50 is located above the feed augers 38*a*, 38*b* adjacent with the developer 30 in the reservoir 29 so that it can pick up developer material. The magnetic core 53 preferably a plurality of magnets 59 for conveying the developer over the 12 o'clock position of the roller 50. As was the case with the magnets 25 in the core 24 of the magnetic brush 22, all of the magnets 59 of the first conveyor roller are arranged to present alternating north and south magnetic poles around the circumference of the rotating shell 55 that are magnetically linked by U-shaped flux lines. The cylindrical shell 55 rotates clockwise and carries developer to the second conveyor roller 63.

The second conveyor roller 63 likewise includes a fixed magnetic core 64 having a plurality of magnets 65 that is surrounded by a rotatable cylindrical conveyor shell 66. Like the shell 55, the shell 66 also rotates clockwise. The magnets 65 of the second conveyor roller produce a magnetic field at the nip 67 between rollers 50 and 63 such that developer is transferred from roller 50 to roller 63 at the nip 67 between the rollers. The clockwise rotation of both of the rollers 50, 63 causes the developer to make a U-shaped turn at the nip 67 as it is transferred to the second roller 63. As a result of its continued clockwise rotation after receiving developer from the first conveyor roller 50, the second conveyor roller 63 delivers developer to the toning shell 26 at the nip 70. The area on the magnetic brush where developer is applied to the brush from the sump is referred to as the feed zone. Here, the developer makes another U-shaped turn and travels over the upper portion of the toning shell 26 through a metering skive 72 and into the nip 27 between the shell 26 and the photoconductor drum 7.

Figure 3B:
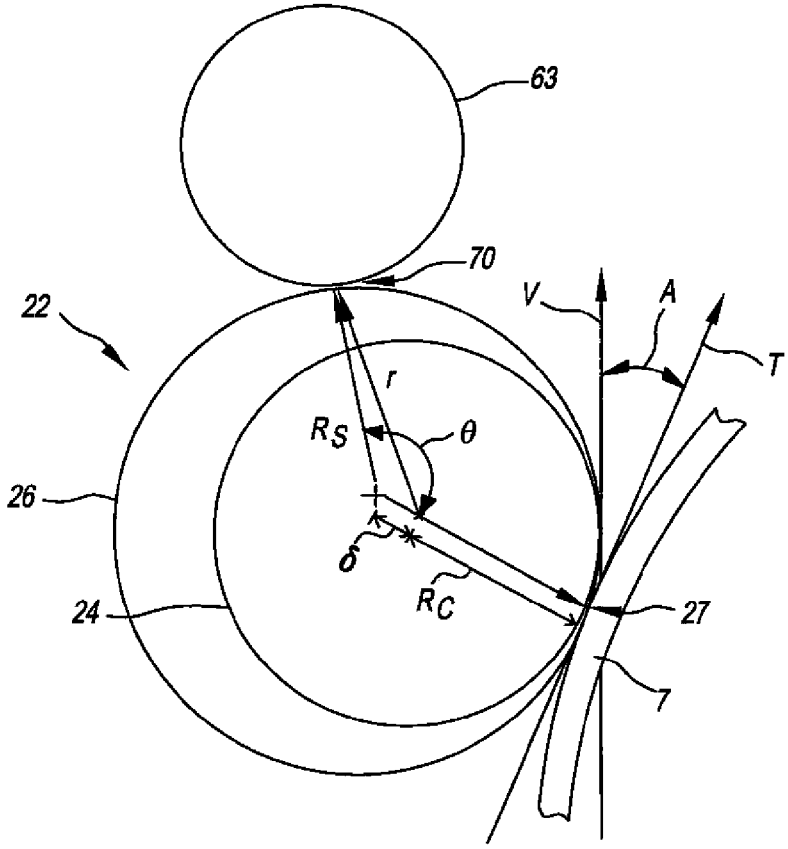
FIG. 3B is a schematic view of the magnetic brush, photoconductor drum and second conveyor roller of the developer station of FIG. 3A, illustrating the angular relationship between the delivery point of the developer on the toning shell of the magnetic brush and the nip between the toning shell and the photoconductor drum.
Figure 3C:
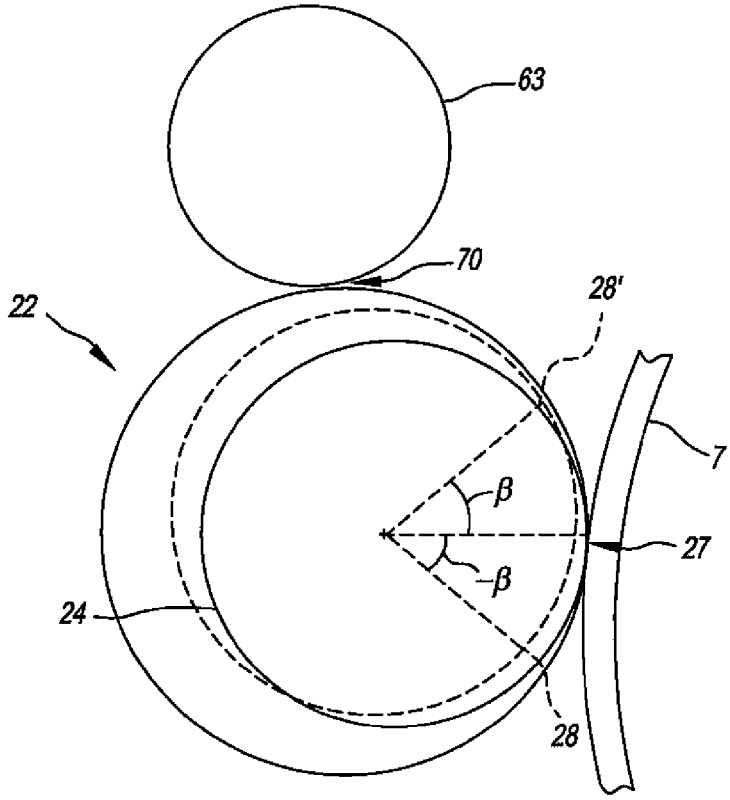
FIG. 3C is a schematic view of the magnetic brush, photoconductor drum and second conveyor roller of the developer station of FIG. 3A, illustrating the angular relationship between the nip between the toning shell and the photoconductor drum and the closest line between the toning shell and the rotating magnetic core of the magnetic brush.

FIG. 3B illustrates the preferred orientation of a tangent line T that is tangent to the nip 27 between the toning shell 26 and the photoconductor drum 7 with respect to a vertical axis V. Preferably, the line T is oriented at an angle A between about +4520 and −45° with respect to vertical axis V. In FIG. 3B, this angle is about +20° and the toning shell 26 is illustrated as contacting the photoconductor drum 7 at about the 10 o'clock position. Angle A would be −20° if the toning shell were illustrated as contacting the photoconductor drum at the 8 o'clock position. More preferably, the angle that the tangent line T makes with the vertical axis V is preferably between about +10° and −10°. Most preferably, the tangent line T is substantially aligned with the vertical axis V, as is shown in FIG. 3C. Such a tangent line orientation allows the developer station 10 to be positioned at one of the sides of the photoconductor drum.

FIG. 3B also illustrates the preferred angular distance θ between the developer delivery point on the toning shell (which in this embodiment corresponds to the nip 70 and is also referred to as the feed zone) and the nip 27 between the toning shell 26 and the photoconductor drum 7 which is preferably less than 120°. Even more preferably, this angular distance θ is 100°. Most preferably, this angular distance θ is 90°. Such an arrangement shortens the residence time of the developer on the toning shell 26, which advantageously reduces both the amount of hysteresis-generated heating of the magnetic carrier particles (which in turn heats the fusible toner particles), as well as the mechanical agitation of the mixture of carrier and toner particles. The lower amount of heating and agitation advantageously avoids embedment of the surface treatments applied to the toner particles, which in turn allows them to maintain their enhanced ability for efficient transport between the toning shell and the photoconductive drum. The lower amount of agitation also reduces the generation of fines and undesirable "dusting" of the toner as it is conveyed by the toning shell 26. Dusting refers to a smoke-like, uncontrolled release of toner particles from the magnetic carrier particles prior to the arrival of the developer at the nip 27. Such dusting can cause an unwanted toner deposition in the light portions of the printed image. In this particular embodiment of the invention, the relatively short angular distance θ is achieved by the use of a second conveyor roller 63 having horizontal and vertical components of spacing with respect to the first roller 50 such that the developer is applied above the center line of the toning shell 26. It should further be noted that the use of two conveyor rollers 50, 63 having a horizontal component of spacing provides the developer station 10 with a relatively short height dimension, which allows it to be positioned adjacent to a side of the photoconductor 7 without mechanical interference with the intermediate transfer web 5 or other components of the printer module.

FIG. 3C illustrates the preferred angular distance β between the line of closest approach 28 of the rotating magnetic core 24 and the toning shell 26 of the magnetic brush 22, and the nip 27 of the toning shell 26 and the photoconductor drum 7. In all embodiments of the developer station of the invention, angle β, the angle between the line of closest approach 28 of the rotating magnetic core 24 and the toning shell 26 and the line through nip 27, is preferably less than between about +30° and −30°. More preferably, angle β is less than between about +10° and −10°. Most preferably, angle β is about 0° such that the nip 27 and the line 28 are horizontally aligned with one another. Such an alignment positions the strongest portion of the magnetic field of the brush 22 at the nip 27 which helps to secure the carrier particles onto the toning shell 26 during toner development, and further positions the weakest part of the magnetic field of the brush 22 on the portion of the toning shell facing away from the photoconductor drum 7, thereby facilitating the removal of residual carrier particles on the shell 26 by skiving.

The operation of the developer station 10 will now be described with reference to FIGS. 3A, 3B, and 3C. The shells 55 and 66 of the first and second conveyor rollers 50, 63 rotate clockwise around their stationary magnetic cores 53 and 64. The magnets 59 in the core 53 of the first conveyor roller 50 attract developer 30 from the reservoir 29 onto the shell 55. The rotating shell 55 conveys this developer 30 to the rotating shell 66 of the second conveyor roller 63. The developer 30 is transferred to the rotating conveyor shell 66 of the second conveyor roller 63 at the nip 67 between the first and second conveyor rollers due to the magnetic field of the magnets 65 in the magnetic core 64 of the second conveyor roller 63. At the nip 67, the layer of developer makes a U-shaped turn as it moves from the first to the second conveyor roller, and continues to move over the top of the second conveyor roller 63. The layer of developer next makes a second U-shaped turn at the nip 70 between the second conveyor roller 63 and the toning shell 26 of the magnetic brush 22 as a result of the greater magnetic strength of the rotating magnetic core 24, where it is transferred to the toning shell 26. As a result of the clockwise rotation of the toning shell 26, the layer of developer 30 is conveyed under a metering skive 72 as insurance against non-uniformities in thickness in route to the nip 27 between the toning shell 26 and the photoconductor drum 7.

In a typical printer module printing 70 pages per minute (PPM), the toning shell 26 may rotate clockwise at 82 rpm while the magnetic core rotates counterclockwise at 800 rpm. While such operational speeds allow a high rate of toner image developing on the photoconductor drum 7, they also create substantial developer agitation and hysteresis-induced heating due to the rapid rate of magnetic flux changes the hard magnetic carrier particles are subjected to as a result of the rotating magnets 25 in the core 24. As described in detail with respect to FIG. 3B, such agitation and heating are substantially reduced by reducing the angular distance between the nip 70 and nip 27 to less than 120° to reduce the residence time of the developer 30 on the toning shell 26. In this first embodiment of the developer station 10 of the invention, such a relatively small angular distance θ is achieved in a station having a magnetic brush capable of applying developer on a photoconductor drum 7 at a 9 o'clock or 3 o'clock position by the horizontally and vertically spaced apart conveyor rollers 50 and 63.

Figure 4:
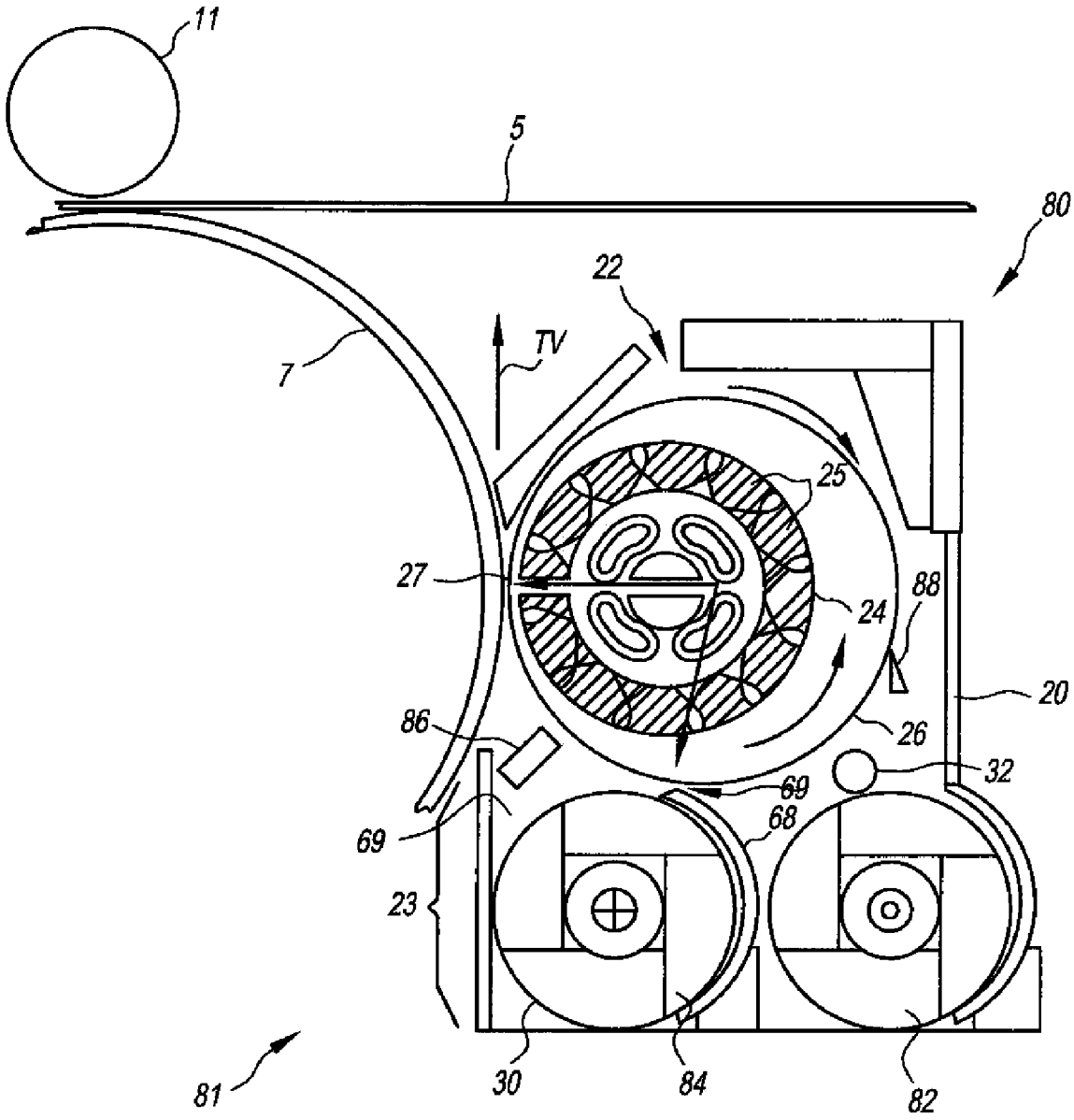
FIG. 4 is a cross sectional side view of second embodiment of the developer station of the invention which does not employ any conveyor rollers.

FIG. 4 illustrates a second embodiment 80 of the developer station of the invention in use in a printer module 81 arranged in an image-over-process configuration as shown in FIG. 1B where the intermediate transfer web contacts the photoconductor drum 7 at the 12 o'clock position. The cleaners 13, 14, charger 16, and writer 18 surrounding the photoconductor drum 7 are not shown for simplicity. In this embodiment, no conveyor rollers are used to transport developer to the toning shell 26 of the magnetic brush 22. Instead, a lower portion of the toning shell 26 directly contacts developer 30 at the developer reservoir 26 contained within the sump 23. A layer of developer is acquired onto the surface of the toning shell at the feed zone containing nip 70 adjacent feed auger 84 and is transported in a clockwise direction through a metering skive 86. The resulting trimmed layer of developer then proceeds into the nip 27 between the toning shell 26 and the photoconductor drum 7. The residual magnetic carrier particles which remain on the toning shell 26 after the transfer of the toner particles at the nip 27 are in turn removed by stripping skive 88 located in the strip zone close to 180° away from the nip 27, where they are deposited over a return auger 82. Return auger 82 mixes the residual magnetic carrier particles removed by the skive 88 with fresh toner particles received from the toner replenisher tube 32, and conveys the reconstituted developer to a feed auger 84 which functions as part of the feed assembly containing two or more augers to supply an uniform layer of developer on the toning shell.

The feed auger is located in the feed channel, on the feed side of the station of FIG. 4. The feed auger is located in the feed channel, on the feed side of the station of FIG. 4. The return auger is located in the return channel, on the return side of the station. The return side is also referred to as the strip side of the developer station. The feed apparatus which moves the developer toward the toning shell has a housing with two or more channel profiles to support two or more auger assemblies. One auger assembly has a continuous auger and the other auger assembly has one or more auger segments that fit the channel profile. The auger segments have intermeshed blades with a helical portion and optional angled paddles. The paddle angles range from 20 to 40 degrees and can have orientation ranges from +/−90 to +/−180 degrees. In one embodiment the auger assembly has adjacent augers of the same handedness that rotate in opposite directions and/or adjacent augers of the opposite handedness that rotate in the same direction. In some embodiments a guide member is placed between the auger assemblies. The guide member can have a curved member with a top portion ending within a region of a magnetic field surrounding the toning shell that exerts a magnetic force greater than or equal to 1 g on the surrounding magnetic carrier particles.

Figure 7A:
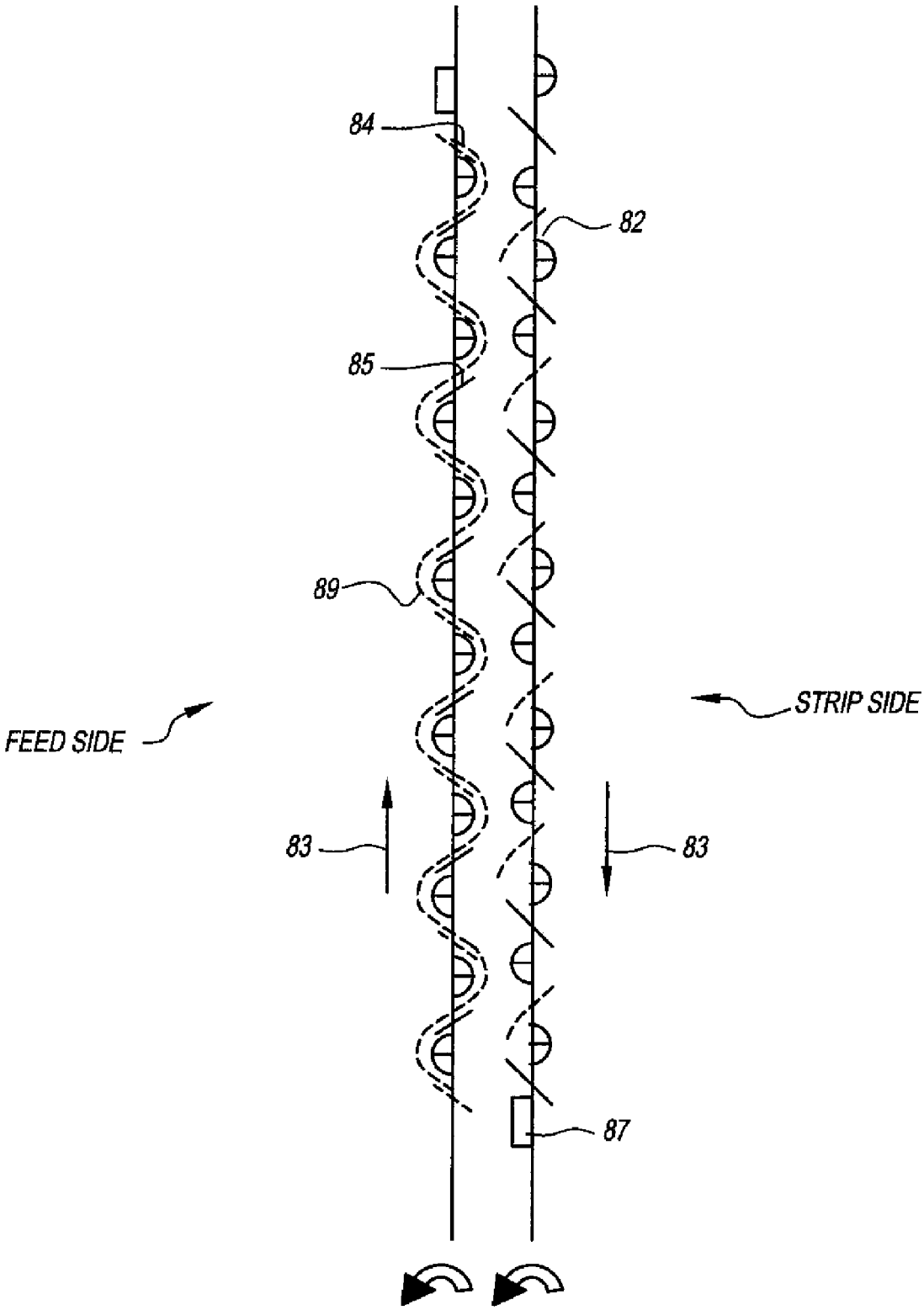
FIG. 7A is a schematic top view of auger configurations.

The return and feed augers 82, 84 operate in essentially the same way as the augers 33*a*, 33*b* and 38*a*, 38*b* described with respect to the first embodiment in that they create a clockwise circulation of developer when viewed from above. However, as developer is fed from the feed auger 84 to the toning shell and circulated (in a direction that is into the plane of the cross section of FIG. 4), there will tend to be less developer in the feed auger longitudinally along the shaft of the auger at the far end of the toning shell. Paradoxically, a countermeasure to depletion of the feed auger and the poor developer feed that can result from this is to implement a feed auger 84 that transports developer at a faster rate than the return auger 82. This causes developer to back up at the far end of feed auger 84, producing a uniform developer level in the sump. This can be done by, for example, by using a continuous helix for the feed auger, or auger segments that approximate a continuous helix, in combination with an interrupted helix for the return auger. For example, if each auger is constructed of auger segments (also referred to as paddles or blades) that are ¼ of a full 360° helix, the feed auger can be composed of a series of segments at 0°, 90°, 180°, and 270° to approximate each turn of the helix, and the return auger can preferably be composed of a series of segments at 0°, −90°, −180°, and −270° to form an interrupted helix. The angle of paddle orientation between two segments is measured clockwise for a right hand auger (counterclockwise for a left hand auger) from a first segment to a second segment that is located down the axis of the auger in the direction of developer flow from the first segment). Augers of this construction are shown in FIG. 7A, where arrows 83 indicate the direction of developer flow for feed auger 84 and return auger 82. Paddles 85 can have an angled paddle angle that preferably ranges from 20° to 40° from a plane perpendicular to the axis of the auger shaft, corresponding to a helix angle of 20° to 40° Flippers 87 are typically angled at an angle of 90° from a plane perpendicular to the axis of the auger shaft, but this angle can range from 45° to 90°. A continuous helix 89 consisting of a single helical web can be used on feed auger 84 instead of paddles approximating a helix. Other configurations can be used for the interrupted helix, as well. For example, paddles for the interrupted helix of this example can be at a relative orientation angle from each other of −90° or −180° (equals 180°) or any other suitable angle.

The full helix of the feed auger 84 conveys developer at a faster rate down the length of the auger than the interrupted helix of the return auger 82. The interrupted helix of the return auger also produces more mixing of toner supplied by replenisher 32 into the developer removed from the toning shell.

Figure 7B:
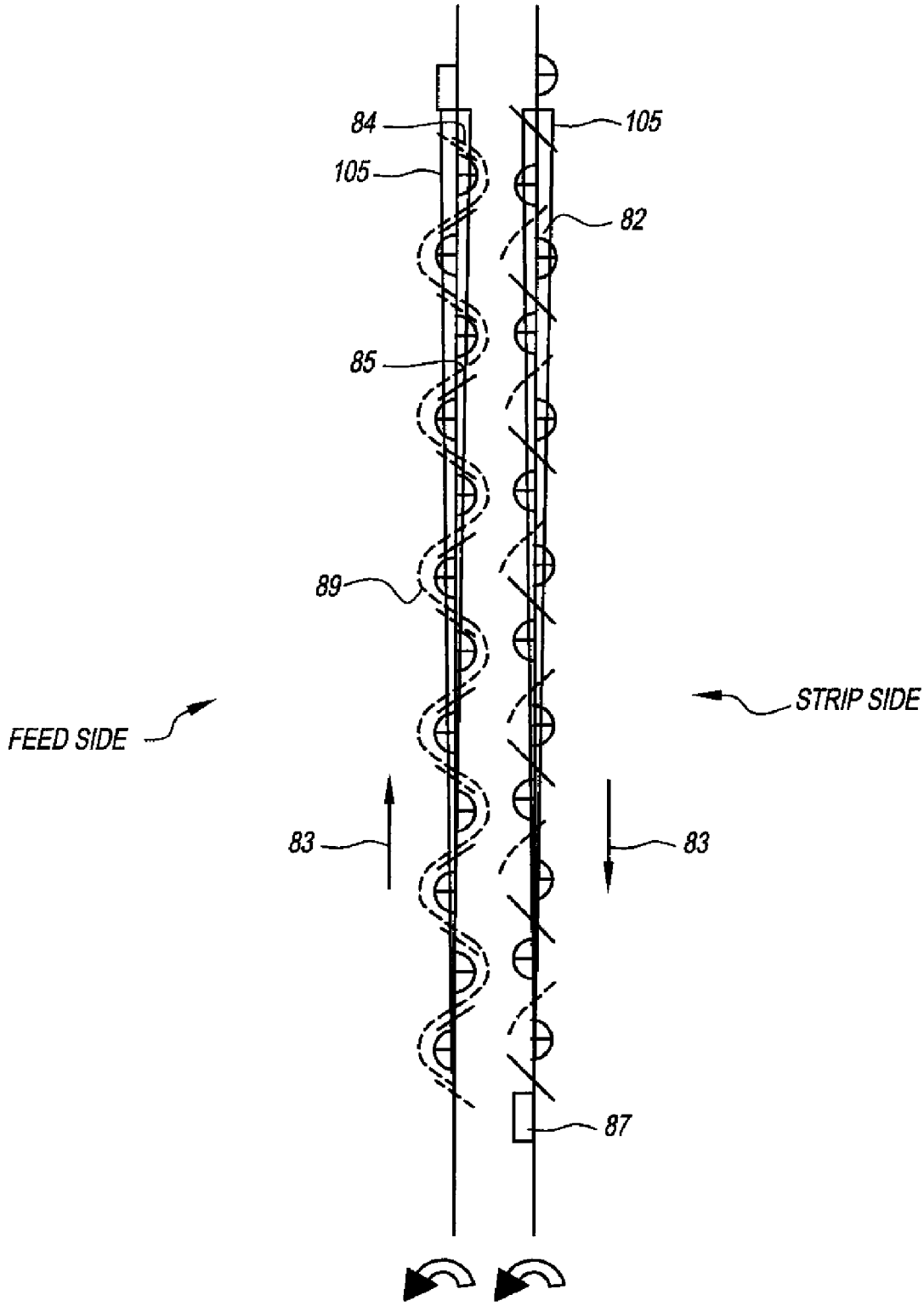
FIG. 7B is a schematic top view of tapered auger configurations

Another means of producing a uniform level of developer is to implement a tapered shaft on feed auger 84 to compensate for the volume removed from auger 84 and fed to the toning shell. A similar taper can be implemented on return auger 82 so that its action on the developer is uniform down the length of the auger shaft. Augers of this construction are shown in FIG. 7B with the tapered shafts 105 shown in phantom An additional means of producing uniform feed is to provide a guide member 68 that will feed developer from the sump to, in this case, toning shell 26. To enable feeding of developer up the wall of guide member 68, feed auger 84 must rotate counter clock wise if right handed and feed developer into the plane of the cross section of FIG. 4, or feed auger 84 must rotate clockwise if left handed and feed developer out of the plane of FIG. 4. This enables developer blocked by metering skive 86 to fall back into feed auger 84. The gap 69 between the guide member and the toning shell can be large enough to allow for overflow of excess developer from the feed channel to the return channel, preferably between approximately 9/10 and 7/10 of the auger diameter that is wherein the guide member extends to within a distance from the toning shell that equals between 9/10 and 7/10ths the total distance. The return auger also feeds developer against the wall on the right as shown in FIG. 4. This enables overflow developer from the feed channel to enter the return channel. It also enables toner provided by toner replenisher tube 32 to mix with developer transported by return auger 82. For the configuration shown in FIG. 4, if the feed auger is right handed and rotating counterclockwise, a return auger that is left-handed and rotating counterclockwise is required. This left handed auger will feed developer out of the plane of FIG. 4 against the wall on the right. If the feed auger of FIG. 4 is left-handed, rotating clockwise, and feeding developer out of the plane of FIG. 4, then a return auger that is right handed, rotating clockwise, and feeding developer into the plane of FIG. 4 is required, and, when viewed from above, circulation in the sump will be counterclockwise.

In the FIG. 4 embodiment 80 of the developer station, the direct engagement between the toning shell 26 and the developer 30 in the reservoir 29 also advantageously allows the angular distance θ to be shortened to about 80°, thereby substantially reducing the residence time of the developer on the toning shell 26 over the prior art. Moreover, the tangent line T at the nip 27 between the toning shell 26 and photoconductor drum 7 is substantially aligned with the vertical axis such that this embodiment may be easily arranged into either a 3 o'clock position as shown or a 9 o'clock position with respect to the photoconductor drum 7.

Figure 5:
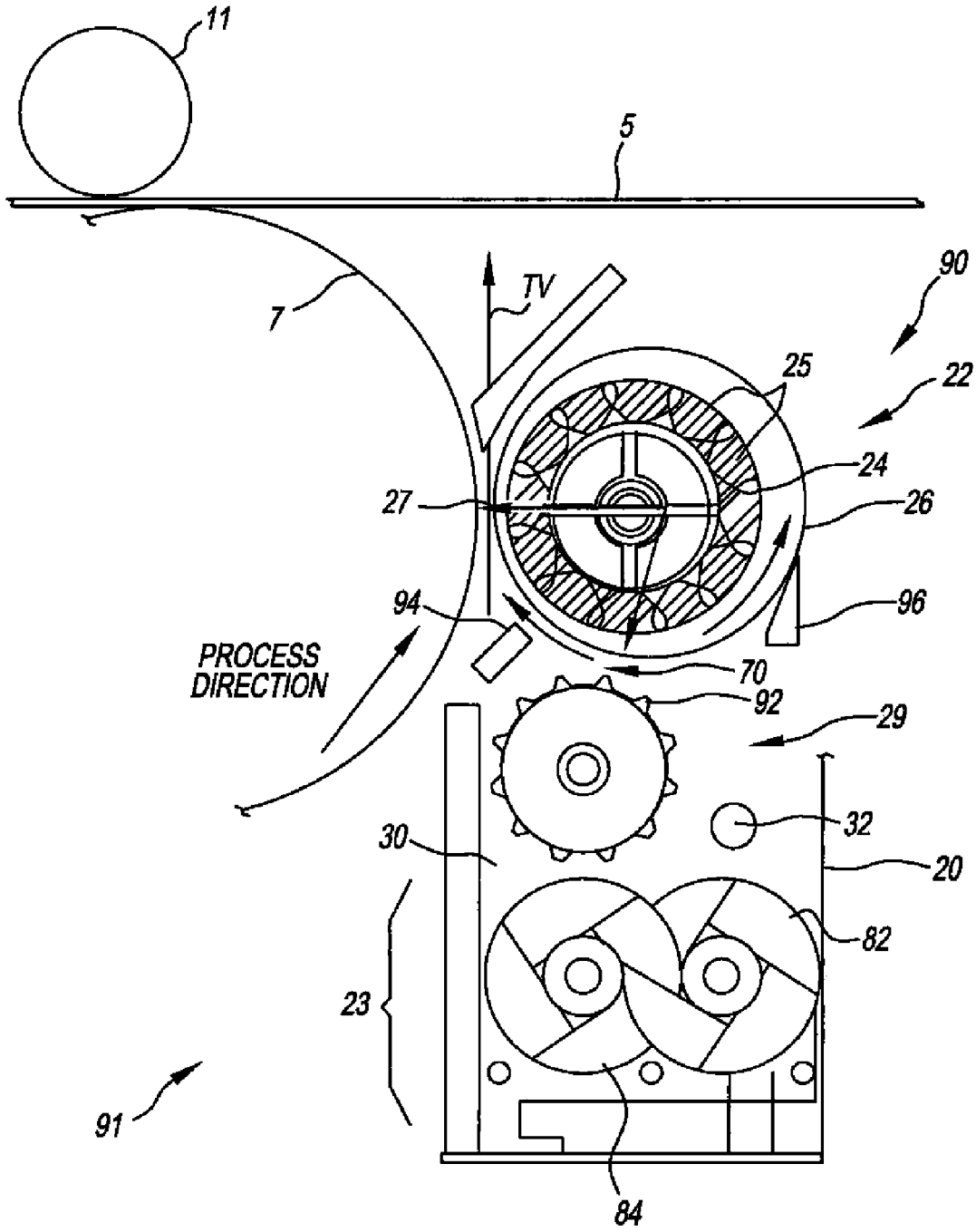
FIG. 5 is a cross sectional side view of third embodiment of the developer station of the invention which employs a single conveyor roller.
Figure 7C:
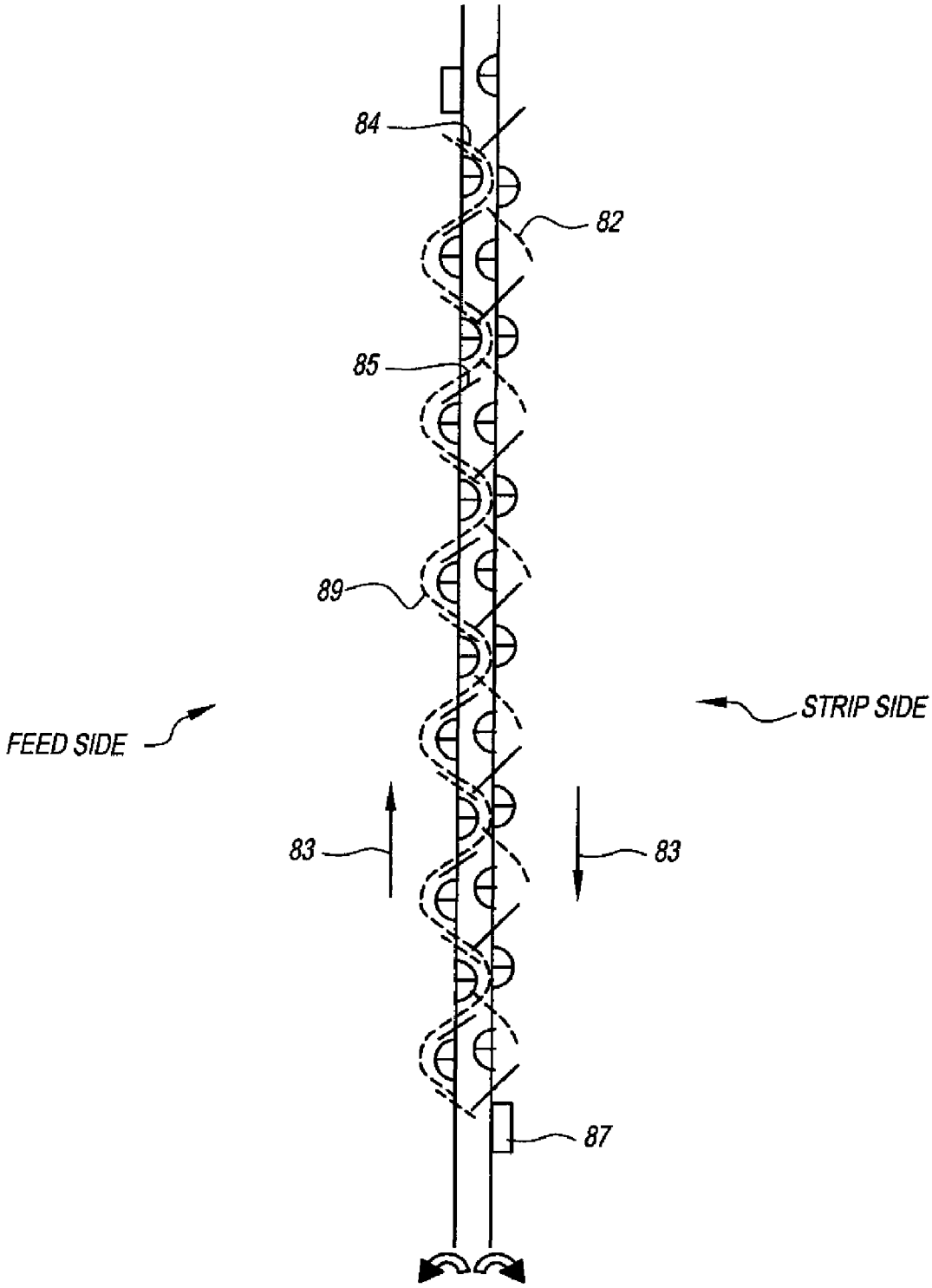
FIG. 7C is a schematic top view of intermeshed auger configurations

FIG. 5 illustrates a third embodiment 90 of the developer station of the invention in use in a printer module 91 again arranged in an image-over-process configuration as shown in FIG. 1B where the intermediate transfer web 5 contacts the photoconductor drum 7 at the 12 o'clock position. Again, the cleaners 13, 14, charger 16, and writer 18 surrounding the photoconductor drum 7 is not shown for simplicity. In this embodiment, the feed auger 84 and the return auger 82 are intermeshed as shown in FIG. 7C. Intermeshed paddles or blades have an overlap range between 0.5x and 0.95x, where x represents the distance between two adjacent auger shafts in the auger assembly.

Figure 7D:
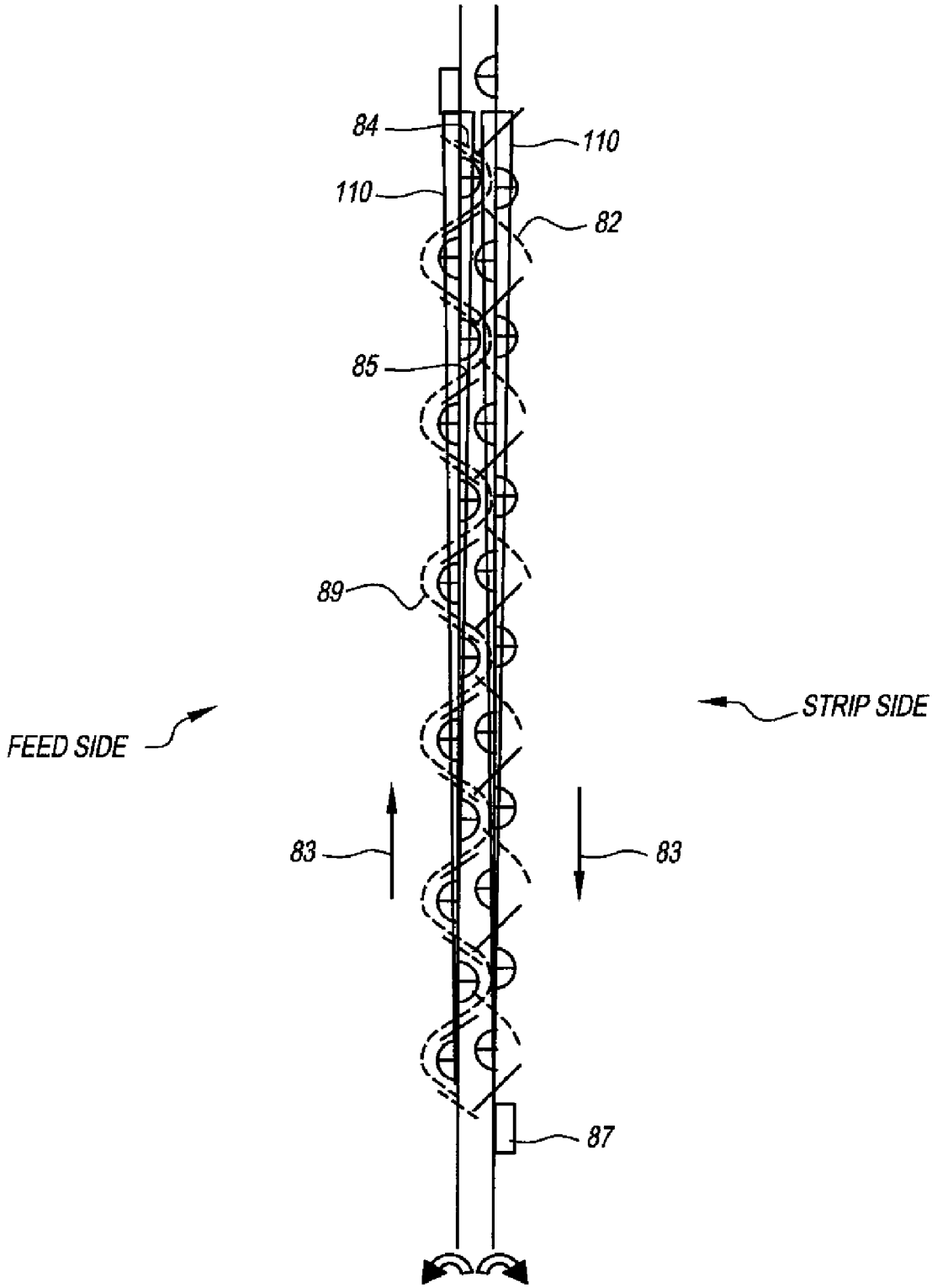
FIG. 7D is a schematic top view of intermeshed tapered and notched auger configurations

If a tapered shaft is used for each auger to compensate for the volume of developer removed from the feed auger or that has not been returned to the return auger the tapered shaft can be notched to allow for the passage of the adjacent auger as shown in FIG. 7D, where the notched tapered shafts 110 are shown in phantom. Preferably, the auger with the tapered shaft in this case is assembled from individual auger segments and a series of individual shaft collar segments. These shaft collar segments are notched to allow for the passage of the adjacent auger.

In FIG. 5, a single, conveyor roller 92 is used to transport developer 30 to the toning shell 26 of the magnetic brush 22 from the reservoir 29 of the sump 23 to the nip 70 in the feed zone. This conveyor roller can be a magnetic roller similar to rollers 55 or 63 of FIG. 2 and FIG. 3A, or it can be a mechanical paddle-type roller as is known in the art. Skives 94 and 96 operate in the same manner described with respect to the skives 86 and 88 of the FIG. 4 embodiment 80. In both embodiments, developer is removed from the magnetic brush in a stripping zone and returned to the sump. The stripping zone contains skives 88 and 96. In this embodiment 90 of the developer station, the positioning of the single conveyor roller 92 toward the photoconductor drum 7 and between the toning shell 26 and the developer 30 in the reservoir 29 advantageously allows the angular distance θ to be shortened to about 80°, thereby substantially reducing the residence time of the developer on the toning shell 26 over the prior art. Again, the tangent line T at the nip 27 between the toning shell 26 and photoconductor drum 7 is substantially aligned with the vertical axis such that this embodiment may be easily arranged into either a 3 o'clock position as shown or a 9 o'clock position with respect to the photoconductor drum 7. The intermeshed auger configuration shown in FIG. 5 can be used for feeding developer directly to the toning shell, as shown in FIG. 4. Similarly, the auger configuration of FIG. 4 can be used to feed developer to a conveyor roller and ultimately to a toning shell as shown in FIG. 5.

As mentioned previously, it is desirable to print at high process speeds. The usefulness of the invention as described and also as shown in FIG. 2 to FIG. 5 can be explained by application of the following examples from U.S. Pat. No. 6,959,162 (also assigned to Eastman Kodak Company of Rochester, N.Y., the entire text of which is hereby expressly incorporated herein by reference) for process speeds ranging from 17.49 inches per second, the equivalent of 110 PPM, to 33.39 inches per second, the equivalent of 210 PPM, and extrapolation to faster speeds. The speed of the developer on the toning shell 26 can be estimated to be approximately equal to the process speed. For example, at 110 PPM or 17.49 inches per second process speed, magnetic core speeds for the magnetic brush 22 of approximately 877 RPM are used, corresponding to 205 pole flips per second for a 14 pole magnetic core. A toning shell speed of 125.5 RPM is used, corresponding for a 2 inch diameter shell to surface speeds of approximately 13.14 inches per second. The developer velocity on the toning shell is approximately 17.49 inches per second. For higher process speeds, the core speed and toning shell speed can be increased proportionally to the process speed. For example, at 150 PPM corresponding to a process speed of 23.85 inches per second, a core speed of 1196.5 RPM can be used, corresponding to approximately 279 pole flips per second, and a toning shell speed of 171.14 RPM is used, corresponding to approximately 17.92 inches per second surface speed. At 220 PPM or a process speed of 34.98 inches per second, a core speed of 1754 RPM can be used, corresponding to approximately 409 pole flips per second, and a toning shell speed of 251 RPM can be used, corresponding to approximately 26.28 inches per second surface speed.

The rate of kinetic energy generated per second contributing to embedment, dusting, and generation of fines is proportional to the square of the number of pole flips per second. For example, a printer that is producing images at 220 PPM will have 4 times the power contributing to embedment and the other problems mentioned than a 110 PPM printer. At a given process speed, the total amount of kinetic energy generated in the developer between transfer of the developer to the toning shell and the toning nip is proportional to the angle θ. For example, at a given process speed, a developer that is transferred to the toning shell within 90 degrees of the development nip will be exposed to only half the kinetic energy resulting from pole flips by the time it reaches the development nip as a developer that is transferred to the toning shell 180 degrees from the nip.

Heat generation in units of power or energy per unit time in the developer due to magnetic hysteresis in the carrier particles during magnetic pole flips is proportional to the number of pole flips per second of the development system. The total amount of heat generated is proportional to the distance traveled on the toning shell. For example, a printer that is producing images at 220 PPM will generate heat due to magnetic hysteresis at approximately 2 times the rate of a 110 PPM printer. The total amount of energy resulting from hysteresis is proportional to the distance traveled on the toning shell by the developer. For example, at a given process speed, a developer that is transferred to the toning shell within 90 degrees of the development nip will be exposed to only half the energy resulting from hysteresis by the time it reaches the development nip as a developer that is transferred to the toning roller 180 degrees from the nip.

Figure 6:
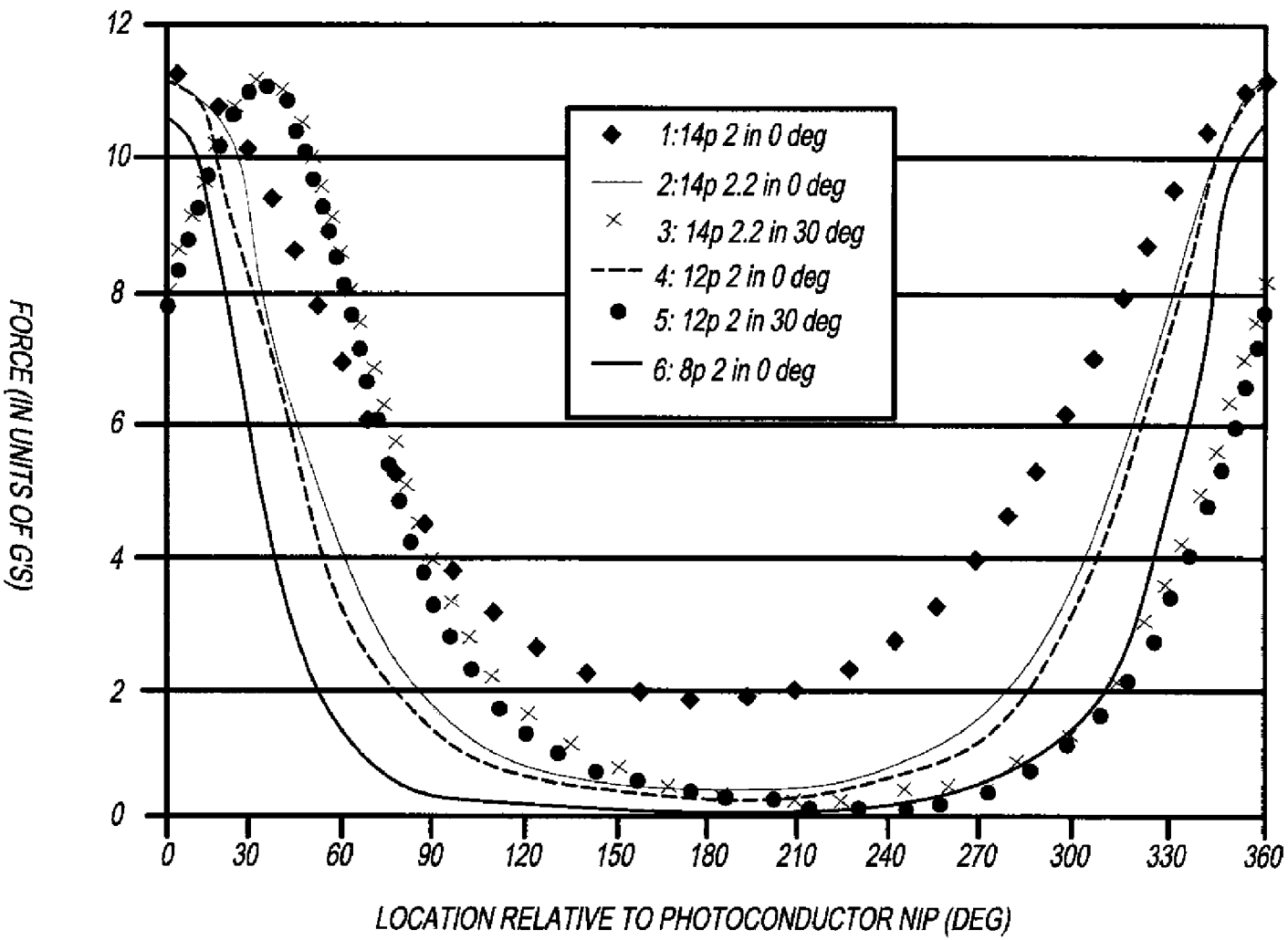
FIG. 6 is a graph of the force produced on a carrier particle by the magnetic field of the development roller for several different magnetic cores and toning shells.

Finally, the performance of the developer station is improved in another embodiment illustrated in FIG. 6 by a graph of the force produced on a carrier particle by the magnetic field of the toning roller for several different magnetic cores and toning shells. When a developer station, such as shown in FIG. 2 to FIG. 5, has a toning shell of a sufficiently large diameter mounted eccentric to the magnetic core, the large diameter toning shell can improve the performance of the skive 31, 88, or 96 or, in a preferred embodiment, cause the developer to fall off the toning shell in the strip zone and return to the sump without requiring a skive. This obviates the need to produce a straight, thin skive 31, 88, or 96 spaced close to the toning shell with a small spacing tolerance. A toning roller that allows the removal of developer by gravity and centrifugal force in the strip zone requires than the force of removal, which is the centrifugal force produced by the rotation of the shell and the force of gravity, be greater than the magnetic force attracting developer or a carrier particle. This requirement is satisfied if the magnetic force is less than the force of gravity, or, more preferably, less than ½ the force of gravity in the strip zone. For toning stations used in the image over process configuration, such as those shown in FIGS. 4 and 5, the force of magnetic attraction within 120° or within 90° of the toning nip is required to be greater than the force of gravity, and preferably at least twice the force of gravity.

In the method of the invention, the diameter of the toning shell and the eccentric offset of the toning shell from the rotating magnetic core are used in combination with the magnetic properties of the rotating magnetic core to improve the skiving and removal of developer from the toning shell after the developer has passed through the nip with the photoconductor element, while also enabling the application of developer to the toning shell at an angular distance of no more than about 120° from the nip, preferably no more than about 90° from the nip, and more preferably in the range 90° to 75° from the nip.

The magnetic field of a rotating magnetic core 24 having N pairs of alternating north and south poles that produce a sinusoidally-varying magnetic field is given by the solution of Laplace's Equation. For the region outside the magnetic core:

$$\nabla^2\phi=0, \qquad \text{(Equation 1)}$$

with the scalar potential $$\varphi(r,\phi) = -B_0\frac{R_C}{N}\left(\frac{R_C}{r}\right)^N\cos(N\phi). \qquad \text{(Equation 2)}$$

In Equation 2, r is the radial distance from the center of the magnetic core in cm, $R_C$ is the radius of the core in cm, $B_0$ is the magnetic field at the surface of the magnetic core in the center of a north or south pole in Gauss, N is the number of magnetic north-south pole pairs, and ϕ is the angle around the magnetic core from the center of one of the north poles arbitrarily taken as an origin. In the following, the north pole origin is also at the location of closest approach of the surface of the magnetic core to the toning shell. This potential corresponds to the magnetic field $$\vec{B}(r,\phi) = B_0\left(\frac{R_C}{r}\right)^{N+1}\left[\hat{r}\cos(N\phi)+\hat{\phi}\sin(N\phi)\right]. \qquad \text{(Equation 3)}$$

The magnetic force $F_M$ for a magnetic core with N pole pairs on a carrier particle with magnetization M emu/g and mass m is directed toward the center of the magnetic core, and $F_M$ has magnitude in g's of $$F_M(\text{in } g's) = \frac{F_M}{\text{mg}} = \frac{mM\nabla\cdot\vec{B}}{\text{mg}} = \frac{MB_0N}{g}\left(\frac{R_C}{r}\right)^N\frac{R_C}{r^2}, \qquad \text{(Equation 4)}$$

The force in g's is a dimensionless number. The acceleration due to gravity g is taken to have the value of 981 cm/s$^2$.

Referring now to FIGS. 3B and 3C, for an eccentrically-mounted toning shell of radius $R_S$ offset a distance δ from the center of the magnetic core of radius $R_C$, the distance r of a point on the toning shell where all distances are in centimeters (cm) from the center of the magnetic core is given by the law of cosines:

$$r=(\delta^2+R_S^2-2\delta R_S\cos(\theta-\beta))^{1/2}, \qquad \text{(Equation 5)}$$

with angles θ and β measured from the photoconductor nip with the toning roller in the direction toward the feed zone and all lengths in cm.

For a carrier particle having magnetization M of 32 emu/g and a typical diameter of 22 to 28 microns, small compared to $R_C$/N, the force $F_M$ in g's on a carrier particle as a function of location on the toning shell is shown in FIG. 6 for several different configurations of toning shell and magnetic core that can be implemented in toning systems of the present invention, as shown in FIG. 3 to FIG. 5. The angle specified on the x axis of FIG. 6 is the angle on the toning shell from the photoconductor nip in the direction toward the conveyor roller or feed zone. The characteristics of the toning rollers of FIG. 6 are listed in Table 1. $B_0$ is 1554.65 Gauss.

TABLE 1

Characteristics of toning rollers of FIG. 6

| Roller | No. of poles | $R_S$ (cm) | $R_C$ (cm) | δ (cm) | β (°) | $F_M$ 180° (g's) | $F_M$ 120° (g's) | $F_M$ 90° (g's) | $F_M$ 75° (g's | $F_M$ 60° (g's) |
|---|---|---|---|---|---|---|---|---|---|---|
| 1 | 14 | 25.37 | 21.56 | 2.54 | 0 | 1.84 | 2.71 | 4.15 | 5.26 | 6.64 |
| 2 | 14 | 27.91 | 21.56 | 5.08 | 0 | 0.41 | 0.77 | 1.59 | 2.45 | 3.80 |
| 3 | 14 | 27.91 | 21.56 | 5.08 | 30 | 0.48 | 1.60 | 3.80 | 5.77 | 8.18 |
| 4 | 12 | 25.37 | 18.48 | 5.62 | 0 | 0.31 | 0.58 | 1.26 | 1.99 | 3.24 |
| 5 | 12 | 25.37 | 18.48 | 5.62 | 30 | 0.36 | 1.26 | 3.24 | 5.19 | 7.75 |
| 6 | 8 | 25.37 | 14.37 | 9.73 | 0 | 0.08 | 0.16 | 0.39 | 0.68 | 1.31 |

For the toning station of FIG. 3 for process over image, the feed zone is approximately 120° to 90° from the photoconductor nip and the strip zone is as distant as approximately 180° from the photoconductor nip, or +/−120° from the photoconductor nip. Note that the nip location is the line of closest approach between the toning shell and the photoconductor member and parallel to the axis of rotation of the magnetic core. In the strip zone, the magnetic force for at least one location along the length of the toning shell should be less than 1 g, and preferably less than 0.5 g. For the toning station configuration of FIG. 4 and FIG. 5 for image over process, the feed zone is at approximately 80° from the photoconductor nip, within the range 75° to 90°. Developer removal occurs in a strip zone approximately 180° from the photoconductor nip, or +/−120° from the photoconductor nip. In the feed zone the magnetic force for at least one location along the length of the toning shell should be at least 1 g, and preferably at least approximately 2 g's. In the strip zone, the magnetic force for at least one location along the length of the toning shell should be less than 1 g, and preferably less than 0.5 g. FIG. 6 shows that toning roller 1, a 14 pole roller nominally 2 inches in diameter, does not satisfy strip zone conditions of $F_M$<1 g. Toning roller 6 does not satisfy feed zone conditions of $F_M$>1 g for the ranges 120° to 90° or 90° to 75° from the photoconductor nip. Rollers 2 to 5 satisfy the preferred strip zone condition of $F_M$<0.5 g as well as the feed zone condition of $F_M$>1 g over the range 90° to 75° from the photoconductor nip. Roller 3 and roller 5 also satisfy the feed zone condition of $F_M$>1 g over the range 120° to 90° from the photoconductor nip as well as satisfying the preferred feed zone condition of $F_M$>2 g over the range 90° to 75° from the photoconductor nip.

The invention as described herein enables improved feeding and mixing by utilizing a development station housing defining two channel profiles to support an improved powder conveyance device in a developer sump. The sump comprises two auger assemblies rotating in opposite directions if the augers have the same handedness or in the same direction if the augers have opposite handedness. The feed channel contains the feed auger primarily transporting developer that is fed to the toning shell directly or to a conveyor roller. The return channel contains the return auger primarily transporting developer that has been removed from the toning shell and is being replenished with toner. Preferably, the feed auger is a full helix or segments approximating a full helix. One or both augers can have a tapered shaft to maintain developer level in the sump. The taper increases in diameter in the direction of developer feed along the axis for the feed channel and decreases in diameter in the direction of developer feed along the axis for the return channel. Guide members can also be utilized to guide developer to conveyor rollers or toning rollers. If the guide member is between the feed and return channel, it can be spaced from the adjacent feed roller or toning shell to allow a gap for developer overflow. In the case that the feed and return augers are intermeshed, the tapered shaft can be notched to allow for the passage of the adjacent auger. Preferably, the auger with the tapered shaft in this case is assembled from individual auger segments and a series of individual shaft collar segments that take up the volume of developer that is removed from the feed auger or has not been returned to the return auger. These shaft collar segments are notched to allow for the passage of the adjacent auger.

Figure 8:
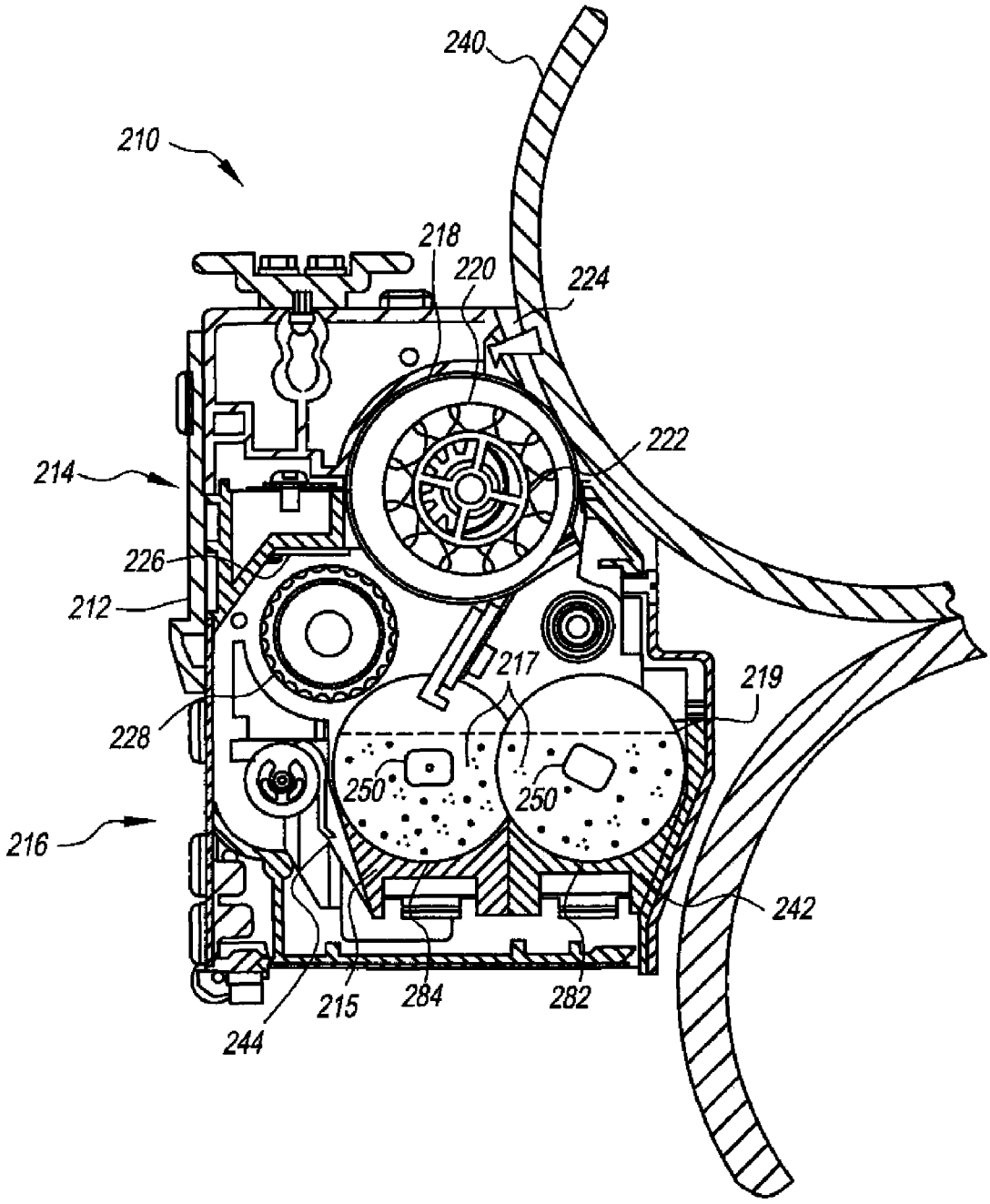
FIG. 8 is a side elevational view, in cross-section, of a reproduction apparatus magnetic brush developer station according to this invention.

FIG. 8 shows an electrostatic printer magnetic brush developer station, according to this invention, sometimes simply referred to as a developer station or toning station, designated generally by the numeral 210. The development station housing 212 encloses a feed apparatus 214 and a powder conveyance device 216 and forms, in part, a reservoir 215 for developer material 217 including a powder and a carrier material. The developer level in the reservoir is shown schematically by dotted line 219. The reservoir is also referred to as a sump. A development roller 218 is mounted within the development station housing 212. The development roller 218 includes a rotating (shown as counterclockwise in FIG. 8) fourteen-pole magnetic core 220 inside a rotating (shown as clockwise in FIG. 8) toning shell 222. The magnetic core 220 and the shell can have many other suitable relative rotations as is known in the art.

The quantity of developer material delivered from the reservoir 215 to the development zone 224 is controlled by a metering skive 226, positioned parallel to the longitudinal axis of the development roller 218, at a location upstream in the direction of shell rotation prior to the development zone. The metering skive 226 extends the length of the development roller 218 The magnetic core 220 does not extend the entire length of the development roller; as such, the developer nap on the shell 222 does not extend to the end of the development roller. The development station 212 may house one or more conveyor rollers 228 to move the developer material within the reservoir of the housing 212 from the mixing area to the toning shell. However, it is possible to feed developer directly from the reservoir to the toning shell.

Figure 9:
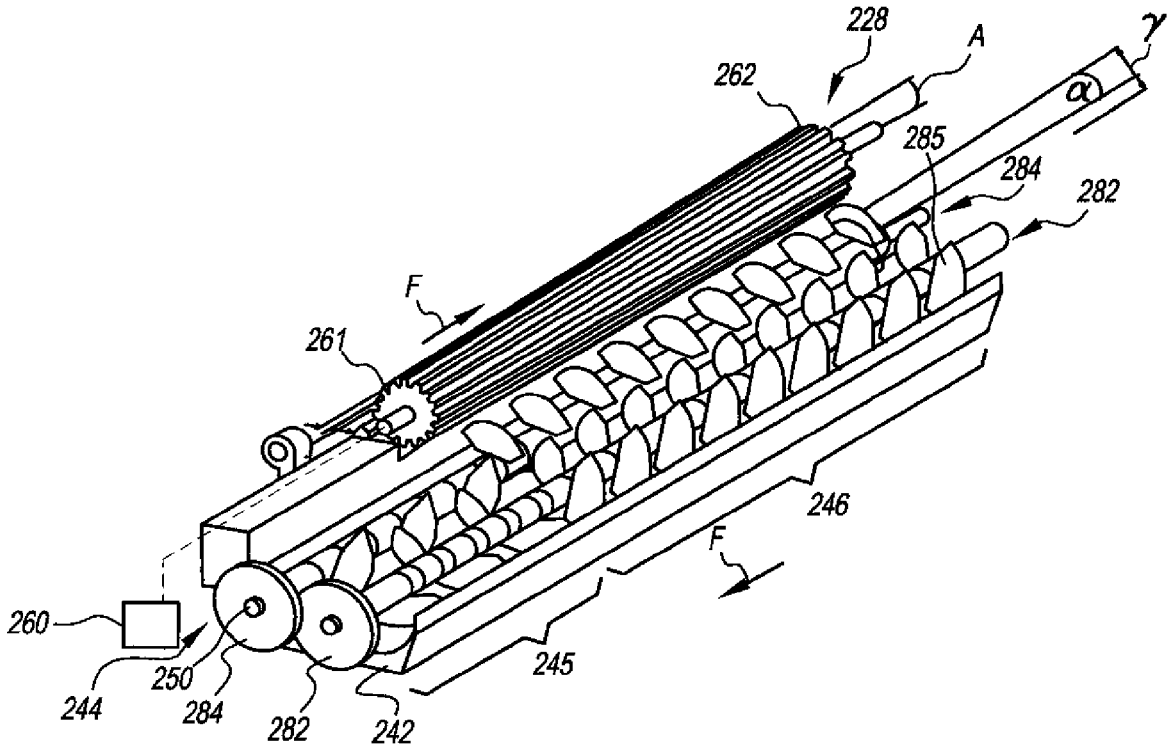
FIG. 9 shows a tapered auger of the magnetic brush development station of FIG. 8.
Figure 10:
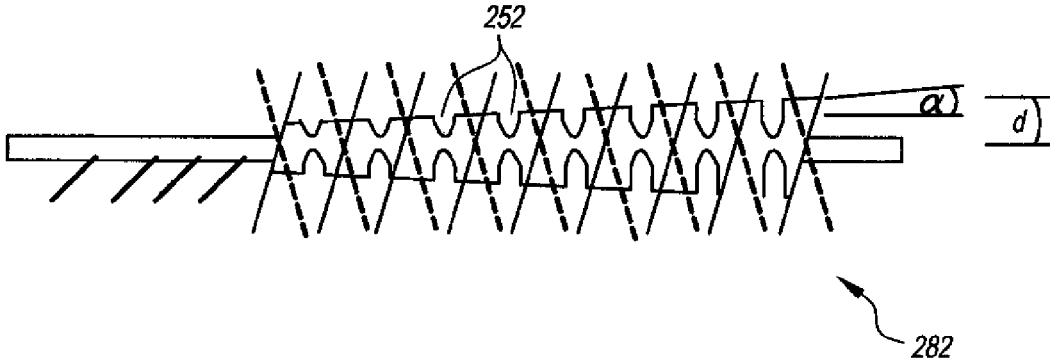
FIG. 10 shows a tapered auger of the magnetic brush development station of FIG. 8., particularly showing other embodiments according to this invention.

FIGS. 9 and 10 show one or more tapered augers 282 and 284, each having a shaft 250. In FIG. 9, auger 284 has a tapered shaft. In FIG. 10 auger 282 (or 284) has one or more variable height shaft collars 252, each of a constant, specific diameter such that there is less volume for developer in the auger as the developer moves in the direction of flow (F) in the feed channel 244 and more volume for developer as the developer moves in the direction of flow (F) in the return channel 242. In the feed channel, 244, this change in the volume encompassed by the auger along the axis of the auger compensates for developer that is removed from the sump and applied to the toning roller. In the return channel 282, this change in the volume encompassed by the auger compensates for developer that is removed from the toning roller and returned to the sump. Generally, each auger has paddles or blades 285 that can move some specific volume of developer 217 per revolution along the axis of the auger. FIG. 10 shows shaft collars, which can also be referred to as sleeves, of diameter 'd' increasing in the direction of the developer flow (F) on the feed auger, and decreasing in the direction of developer flow (F) on the return auger. This is sometimes referred to as volume bias. These sleeves are notched to provide clearance for the blades of an adjacent, interleaved auger. Developer feed uniformity is improved by creating a variable shaft diameter 'd' on the augers. This can be accomplished by machining a taper on a series of shaft collars that are to be assembled on the auger shaft as shown in FIG. 9 or by using a series of shaft collars of increasing diameter as shown in FIG. 10.

The magnetic brush development station 210, shown in FIG. 8 and FIG. 9, uses one conveyor roller, although more than one conveyor roller or none could be used in conjunction with the tapered augers. Controller 260 controls the development station including the tapered augers 282 and 284 as shown in FIG. 9. The controller also controls the powder-conveying device in the reservoir, such that the auger preferentially mixes in the mixing space 245 and transports in the second transport space 246 as the powder is conveyed toward the conveyor roller 228 as shown in FIG. 8. The tapered augers 282 and 284 described above allow a more uniform level of developer in the reservoir as the developer moves in the direction of flow (F) and circulates around the sump in a counter-clockwise direction as viewed from above.

Figure 11:
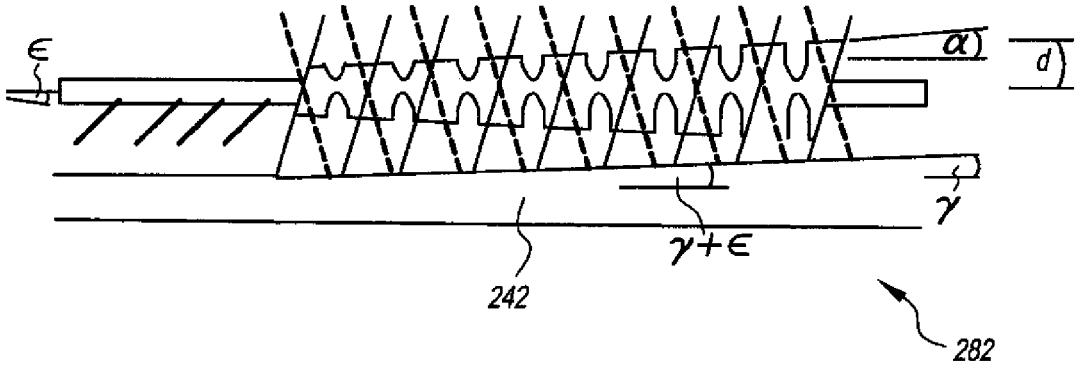
FIG. 11 shows a tapered auger of the magnetic brush development station of FIG. 8, particularly showing other embodiments according to this invention.

Developer feed uniformity is improved by tapering the auger shafts. In one embodiment this is achieved using shaft collars of variable diameter 'd' on the auger shaft as shown in FIG. 9 and discussed above to provide a taper angle $\alpha$. This can also be accomplished by varying other features of the augers that result in developer feed uniformity and specifically encourage a higher developer level in areas of the sump where the amount of developer tends to be low, such as at the second end 262. FIG. 11 shows an auger 282 with an external blade taper angle $\gamma$ and a shaft tilt angle $\epsilon$ as well as the variable shaft diameter 'd' approximating a taper angle $\alpha$. Theses features could be combined or used separately to control the volume bias as required. The paddles 217 can also have one or more surface features, such as texture or pockets that might effectively create a bucket type effect, to further stabilize the volume of developer moved toward the toning shell.

The developer station includes a sump for holding a reservoir of magnetic developer including toner and carrier and a magnetic roller mounted above said sump and including a rotatable magnetic core surrounded by a substantially cylindrical rotatable toning shell rotatably mounted with respect to the core, said shell being adjacent to the photoconductor drum and defining a nip and a conveyance device for transporting developer in the developer station in a flow direction. The conveyance device has, in one embodiment, a tapered auger including a shaft and one or more blades such that the developer volume in the flow direction is controlled to maintain a uniform developer level in the sump as well as a conveyance controller for controlling the conveying device, including the tapered auger such that the tapered auger preferentially creates an uniform layer of developer on the toning shell. The auger can improve developer delivery by a number of embodiments including increasing a shaft diameter in the flow direction for a feed auger and decreasing the shaft diameter in the flow direction for a return auger. The tapered auger has the blade tapered angle $\gamma$ tilted at shaft tilt angle $\epsilon$ in the direction of the toning shell to further control the level of volume of developer in the sump. The tapered auger taper angle $\alpha$ controls a developer volume in the feed channel within a range that results in an uniform layer of developer in the sump within +/−0.5 inches on average. In another embodiment the tapered auger angle is less then 5 degrees and the tapered feed roller is angled a shaft tilt angle $\epsilon$ between 0 and 5 degrees towards the toning shell. The conveyance controller can control the speed and the tilt angle of the auger in some embodiments. The conveyance controller can control a tilt angle to further control the volume of developer moved toward the feed apparatus.

Various embodiments can be used to compensate for the change in the relative volumes of developer traveling in direction F. These include tapering the shaft diameter or auger diameter and/or sloping the whole reservoir the required amount to effect the desired constant developer level by compensation for the volume of developer removed or returning to the sump, machining a taper on a solid auger shaft or blade made from a cylinder, or some other similar method of providing volume bias. This variable volume associated with each auger is oriented such that the effective blade height 'a' decreases in the direction of the developer flow (F) in the feed channel and increases in the direction of the developer flow (F) in the return channel. Since during operation there is normally more developer at the first or front end 261 of the conveyor roller 228 than at the second or rear end 262, as shown in FIGS. 9 to 11, the tapered augers compensate for this effect. This is important since when there is less developer left in the feed channel the pick-up point at the surface of the developer in the channel becomes even further from the conveyor roller or development roller. The tapered auger allows the rear of reservoir to hold less developer and provides the same developer height in the rear as in the front of the reservoir, thereby resulting in more uniform pick-up by the conveyor roller or toning shell and thus more efficient and higher quality prints.

In this application, the term "electrographic printer" is intended to encompass electrophotographic printers and copiers that employ dry toner developed on any type of electrophotographic receiver element (which may be a photoconductive drum or belt), as well as ionographic printers and copiers that do not rely upon an electrophotographic receiver.

The invention has been described in detail with particular reference to certain preferred embodiments thereof, but it will be understood that variations and modifications can be effected within the spirit and scope of the invention.

PARTS LIST

1) printing apparatus
3) printer modules a-e
5) intermediate transfer web
7) photoconductor element
8) web rollers
10) developer station
11) charged back-up bar
12) pre-cleaner
13) toner image
14) cleaning brush
16) corona charger
18) optical image writer
20) housing
22) magnetic brush
23) sump
24) rotatable magnetic core
25) magnets
26) toning shell

27) nip
28) line of closest approach
29) reservoir of developer
30) developer
31) skive
32) toner replenisher tube
33) return augers a, b
34) screw blades a, b
38) feed augers a, b
40) screw blades a, b
48) central portion of sump
50) first conveyor roller
53) magnetic core
55) rotating shell
59) small magnets
61) skive
63) second conveyor roller
64) magnetic core
65) magnets
66) rotating cylindrical conveyor shell
67) nip
68 guide member
69 gap
70) nip
72) skive
74) skive
80) second embodiment
81) printer module
82) return auger
83) direction of developer flow
84) feed auger
85) paddle
86) metering skive
87) flipper
88) stripping skive
89) continuous helix
90) third embodiment
92) single conveyor roller
94) metering skive
96) stripping skive
100) paper
105) tapered shaft
110) notched and tapered shaft
120) fuser apparatus

What is claimed is:

1. A developer station for an electrographic printer having a photoconductor member, comprising:

a sump for holding a reservoir of magnetic developer comprising toner and carrier and a magnetic roller mounted above said sump and including a rotatable magnetic core surrounded by a substantially cylindrical rotatable toning shell rotatably mounted with respect to the core, said shell being adjacent to the photoconductor member and defining a nip; and a conveyance device for transporting developer in the developer station in a flow direction comprising:

a. a tapered auger comprising a shaft and one or more blades such that the developer volume in the flow direction is controlled to maintain a uniform developer level in the sump; and b. a conveyance controller for controlling the conveying device, including the tapered auger such that the tapered auger preferentially creates an uniform layer of developer on the toning shell.

2. The conveyance device of claim 1, further comprising an increase in shaft diameter in the flow direction for a feed auger.

3. The conveyance device of claim 1, further comprising a decrease in the shaft diameter in the flow direction for a return auger.

4. The conveyance device of claim 1, further comprising a tapered auger with an external blade taper angle $\gamma$ tilted at shaft tilt angle $\epsilon$ in the direction of the toning shell to further control the level of volume of developer in the sump.

5. The conveyance device of claim 4, wherein the tapered auger has a taper angle $\alpha$ that controls a developer volume in a feed channel in the sump within a range that results in an uniform level of developer in the sump within +/−0.5 inches on average.

6. The conveyance device of claim 4, wherein the tapered auger taper angle $\alpha$ is less than 5 degrees.

7. The conveyance device of claim 4, wherein the tapered auger has a shaft tilt angle $\epsilon$ between 0 and 5 degrees towards the toning shell.

8. The conveyance device of claim 1, the conveyance controller further controlling a blade angle to further control the volume of developer moved toward the toning shell.

9. The conveyance device of claim 1, the conveyance controller further controlling a tilt angle to further control the volume of developer moved toward the toning shell.

10. The conveyance device of claim 1, wherein the conveyance controller controls the auger speed.

11. The conveyance device of claim 1, the blade has one or more surface features to further move the volume of developer moved toward the toning shell.

12. The conveyance device of claim 1, wherein the tapered auger has a tapered shaft that includes notches to allow for the passage of an adjacent auger.

13. The conveyance device of claim 1 further including one or more variable height shaft collars each of a constant, specific diameter.

14. The conveyance device of claim 1, the conveyance controller controlling both the tilt and the speed of the auger.

15. A method of conveying developer to a feed apparatus, the method comprising:

a. moving a developer comprising a developer including a magnetic carrier in the flow direction along a length of a tapered auger wherein the auger comprises one or more blades such that the developer volume is controlled in the flow direction; and b. controlling the movement of the developer such that the tapered auger preferentially conveys the developer toward a toning shell so there is a volume bias along the length of the auger in the flow direction resulting in uniform layer of developer on the toning shell that is adjacent to the length of the auger.

16. The method of claim 15, further comprising an increase in a shaft diameter of the tapered auger in the flow direction.

17. The method of claim 15, further comprising a decrease in a shaft diameter of the tapered auger in the flow direction.

18. The method of claim 15, wherein the tapered auger is tilted in a tapered auger with an external blade taper angle $\gamma$ tilted at shaft tilt angle $\epsilon$ in the direction of the toning shell to further control a level of volume of developer in a sump.

19. The method of claim 18, wherein the tapered feed auger controls a developer volume in the feed auger conveyed toward the feed apparatus within a range that results in a uniform volume on the tapered auger by simultaneously optimizing maximum mean developer flow along a feed auger length and a minimum total range of developer flowing from front to rear of the feed auger as developer is moved toward the feed apparatus.

20. The method of claim 15, wherein the tapered feed auger shaft tilt angle $\epsilon$ is between 0 and 5 degrees towards the toning shell.

21. The method of claim 15, the method further comprising a blade internal angle ranging from 20-40 degrees.

22. The method of claim 15, the method further comprising controlling a spacing between the tapered auger and a wall to further control the uniform movement of developer toward the feed apparatus.

23. The method of claim 15, the method further comprising controlling the tapered auger rotation to further control the uniform movement of developer toward the feed apparatus.

24. The method of claim 15, further including a notched tapered shaft to allow for the passage of an adjacent auger in order to increase the volume of developer moved toward the feed apparatus.

25. The method of claim 15, further including tilting a sump to further control a volume of developer moved toward the feed apparatus.

* * * * *